US008312873B2

(12) United States Patent
Gagas et al.

(10) Patent No.: US 8,312,873 B2
(45) Date of Patent: Nov. 20, 2012

(54) LOW DEPTH TELESCOPING DOWNDRAFT VENTILATOR

(75) Inventors: John M. Gagas, Milwaukee, WI (US); Peter F. Sosso, Hustisford, WI (US)

(73) Assignee: Western Industries, Inc., Watertown, WI (US)

( * ) Notice: Subject to any disclaimer, the term of this patent is extended or adjusted under 35 U.S.C. 154(b) by 947 days.

(21) Appl. No.: 11/838,621

(22) Filed: Aug. 14, 2007

(65) Prior Publication Data

US 2008/0029081 A1 Feb. 7, 2008

Related U.S. Application Data

(60) Provisional application No. 60/822,353, filed on Aug. 14, 2006.

(51) Int. Cl.
*F24C 15/20* (2006.01)

(52) U.S. Cl. ..... 126/299 D; 126/299 R; 454/63; 454/64; 454/66; 55/471

(58) Field of Classification Search ..... 126/299 D, 126/299 R, 200 E; 454/64, 63, 66, 341, 344; 55/471, DIG. 36; *F24C 015/20*
See application file for complete search history.

(56) References Cited

U.S. PATENT DOCUMENTS

| | | | | | |
|---|---|---|---|---|---|
| 2,482,952 | A | * | 9/1949 | Warren | 126/299 R |
| 2,525,614 | A | * | 10/1950 | Nelson et al. | 126/299 R |
| 2,586,023 | A | * | 2/1952 | Gillette | 126/21 A |
| 2,595,480 | A | * | 5/1952 | Nelson et al. | 126/299 R |
| 2,634,718 | A | * | 4/1953 | Williams | 126/21 A |
| 2,638,893 | A | * | 5/1953 | O'Keefe | 126/299 R |
| 2,974,663 | A | * | 3/1961 | Humbert | 126/299 R |
| 3,011,492 | A | * | 12/1961 | Humbert | 126/299 R |
| 3,367,320 | A | * | 2/1968 | Jenn | 126/300 |
| 3,409,005 | A | * | 11/1968 | Field | 126/300 |
| 3,797,375 | A | | 3/1974 | Cerola | |
| 4,013,859 | A | | 3/1977 | Peters, Jr. | |
| 4,114,009 | A | | 9/1978 | Kiuchi et al. | |
| 4,149,217 | A | | 4/1979 | Tucker | |
| 4,169,222 | A | | 9/1979 | Tucker | |
| 4,191,875 | A | | 3/1980 | Cunningham | |
| 4,206,336 | A | | 6/1980 | Cunningham | |
| 4,308,443 | A | | 12/1981 | Tucker et al. | |
| 4,396,818 | A | | 8/1983 | Kominami et al. | |

(Continued)

FOREIGN PATENT DOCUMENTS

| | | |
|---|---|---|
| CA | 2137648 | 8/1995 |

(Continued)

*Primary Examiner* — Steven B McAllister
*Assistant Examiner* — Daniel E Namay
(74) *Attorney, Agent, or Firm* — Boyle Fredrickson, S.C.

(57) ABSTRACT

A low depth telescoping downdraft ventilator controlled by an electronic controller providing a precisely controlled and efficient way of removing gases and fumes is disclosed. The low depth telescoping downdraft ventilator has the ability to fit behind a built-in oven placed below a cook top unit. The telescoping downdraft ventilator has an almost infinitely selectable range of heights above a cook top with a built in oven. The ventilator collects and draws in exhaust fumes and smoke, filters it and re-circulates or expels it either outdoors or indoors. The inner member of the telescoping ventilator may house the exhaust fans and may move up or down without the use of mechanical switches for elevation detection and stopping. The ventilator may have sensors to detect temperatures, filter change need, fan speeds, telescoping stop points, energy consumption, resistance and voltage, enabling programmable set point operation.

19 Claims, 19 Drawing Sheets

U.S. PATENT DOCUMENTS

| | | | | |
|---|---|---|---|---|
| 4,431,892 | A | 2/1984 | White | |
| 4,446,350 | A | 5/1984 | Mizukawa et al. | |
| 4,446,849 | A | 5/1984 | McFarland | |
| 4,447,691 | A | 5/1984 | Mizukawa et al. | |
| 4,453,068 | A | 6/1984 | Tucker et al. | |
| 4,501,260 | A | 2/1985 | Grace | |
| 4,511,781 | A | 4/1985 | Tucker et al. | |
| 4,562,827 | A | 1/1986 | Cerola | |
| 4,603,684 | A | 8/1986 | Kazuo et al. | |
| 4,650,171 | A * | 3/1987 | Howorth | 5/600 |
| 4,686,340 | A | 8/1987 | Fukasawa | |
| 4,701,588 | A | 10/1987 | Fukasawa | |
| 4,736,729 | A | 4/1988 | Beach | |
| 4,750,470 | A | 6/1988 | Beach et al. | |
| 4,757,177 | A | 7/1988 | Suzuki et al. | |
| 4,766,880 | A | 8/1988 | von Blanquet | |
| 4,784,114 | A | 11/1988 | Muckler et al. | |
| 4,810,847 | A | 3/1989 | Ito | |
| 4,833,288 | A | 5/1989 | Poumey | |
| 4,846,146 | A | 7/1989 | Tucker et al. | |
| 4,886,046 | A | 12/1989 | Welch | |
| 4,887,587 | A | 12/1989 | Deutsch | |
| 4,889,104 | A | 12/1989 | Gostelow | |
| 4,908,489 | A | 3/1990 | Panecki et al. | |
| 4,934,337 | A | 6/1990 | Falk | |
| 4,945,891 | A | 8/1990 | Cecil | |
| 4,951,646 | A | 8/1990 | Dickmann et al. | |
| 5,000,160 | A | 3/1991 | Dunlop et al. | |
| 5,001,970 | A | 3/1991 | Graver | |
| 5,010,223 | A | 4/1991 | Kim | |
| 5,062,410 | A | 11/1991 | Sarnosky et al. | |
| D327,538 | S | 6/1992 | Falk et al. | |
| 5,119,802 | A | 6/1992 | Cherry et al. | |
| 5,158,068 | A | 10/1992 | Pickering | |
| 5,190,026 | A | 3/1993 | Doty | |
| 5,208,217 | A | 5/1993 | Katsoyannis | |
| 5,209,217 | A | 5/1993 | Beach et al. | |
| 5,231,972 | A | 8/1993 | Galassi | |
| 5,279,279 | A | 1/1994 | White | |
| 5,287,799 | A | 2/1994 | Pickering et al. | |
| 5,301,653 | A | 4/1994 | Gerdes et al. | |
| 5,325,842 | A | 7/1994 | Beach et al. | |
| 5,577,490 | A | 11/1996 | Overton, Jr. | |
| 5,619,982 | A | 4/1997 | Kelly et al. | |
| 5,687,707 | A | 11/1997 | Prasser | |
| 5,690,093 | A | 11/1997 | Schrank et al. | |
| 5,884,619 | A | 3/1999 | Terry | |
| 6,000,391 | A | 12/1999 | Timmons | |
| 6,044,838 | A * | 4/2000 | Deng | 126/299 D |
| 6,119,680 | A | 9/2000 | Barritt | |
| 6,168,378 | B1 | 1/2001 | Craw et al. | |
| 6,276,358 | B1 | 8/2001 | Brin, Jr. et al. | |
| 6,293,276 | B1 | 9/2001 | Owens et al. | |
| 6,297,482 | B1 | 10/2001 | Becker | |
| 6,455,818 | B1 | 9/2002 | Arntz et al. | |
| 6,501,053 | B2 | 12/2002 | Becker et al. | |
| 6,575,157 | B1 | 6/2003 | Shaver | |
| 6,634,939 | B2 | 10/2003 | Johnson | |
| 6,698,419 | B2 | 3/2004 | Lee | |
| 6,715,484 | B2 | 4/2004 | Khosropour et al. | |
| 6,807,962 | B2 | 10/2004 | Taplan et al. | |
| 6,821,318 | B2 | 11/2004 | Khosropour | |
| 6,877,506 | B2 | 4/2005 | Shekarri | |
| 7,021,308 | B2 | 4/2006 | Caruso | |
| 2006/0278215 | A1 * | 12/2006 | Gagas et al. | 126/299 D |

FOREIGN PATENT DOCUMENTS

| | | |
|---|---|---|
| CA | 2343301 | 10/2001 |
| CA | 2390458 | 12/2002 |
| CA | 2391688 | 10/2003 |
| CA | 2105030 | 12/2003 |
| CA | 2466258 | 8/2005 |
| CA | 2506249 | 12/2005 |

* cited by examiner

FIG. 11
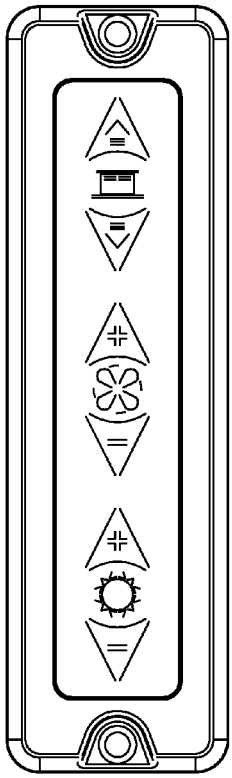
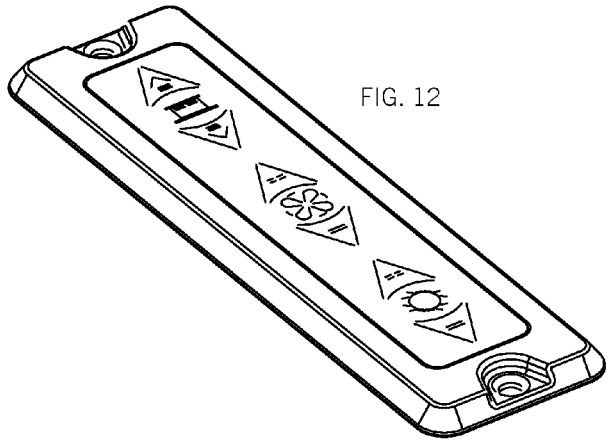
FIG. 12

LOW DEPTH TELESCOPING DOWNDRAFT VENTILATOR

CROSS-REFERENCE(S) TO RELATED APPLICATION(S)

This application claims a benefit of priority under 35 U.S.C. §119 based on patent application Ser. No. 11/194,867, filed Aug. 1, 2005, patent application Ser. No. 11/232,050, filed Sep. 1, 2005, and patent application Ser. No. 60/822,353, filed on Aug. 14, 2006, the entire contents of which are hereby expressly incorporated by reference into the present application.

BACKGROUND OF THE INVENTION

1. Field of the Invention

The present invention pertains to cooking appliances and, more particularly, to a telescoping downdraft ventilator with the ability to fit behind an appliance such as a built in oven placed below a cook top.

2. Discussion of the Related Art

Telescoping downdraft ventilators of present designs are long rectangular boxes having a construction of an inner and outer box of single walled or a double walled with insulating air in between the telescoping and base housing. There is also a telescoping rectangular box of some sort to open up the interior of the box for exhausting. Typically, there is about 1¾ inches in depth shown at the top when the ventilator cap is closed. Standard widths range from 27 inches to 48 inches. The top trim of the telescoping rectangular box is fixed in a horizontal plane and is found flush with the counter. The centrifugal type fan/blower, attached to the base housing, has been by a single blower, attached on the side with airflow at 90 degrees from the side of the base box. The overall size of an attached fan/blower ranges from six to twenty-three inches, the components of which, e.g., a fan/blower, motors, mechanical components and sheet metal, is installed under a cabinet. The typical blower has been designed to draw air down with the use of a centrifugal-type fan/blower. The blower removes contaminated air from a cook top surface, removes the interior air of the box and either exhausts it outside or returns it to the room. A centrifugal fan creates higher pressures than an axial flow fan. In present designs, the airflow stream must move across the work area, being pulled from the front of the work area to the back where the ventilator is located. The air must travel through a ninety degree turn once inside the chamber and move downward. The air stream must take another 90 degree turn into an opening with a smaller diameter than the ventilator chamber. At this point, the air stream has entered the blower and a centrifugal fan/blower redirects the air downward for exhausting. With the numerous bends and turns the air stream must take, a large amounts of draw (i.e., vacuum, or suction) is needed to overcome these losses. The large draw requires a large motor which increases costs, noise, size and weight.

With the new trend of having a drop-in cook top surface on a counter with a built-in wall oven placed below the cook top in a standard cabinet, the space behind the cabinet is limited to less than one inch of space or less. A typical telescoping down draft ventilation system is about six inches in depth and therefore cannot fit it in the back of a cook top while providing enough space for the oven. Further, present ventilation systems on the market go through long runs of ducting in order to have a fan/blower located remotely. By not having the fan/blower part of the telescopic down draft, issues such as drawing air into the system, wiring, user control and installation problems may arise.

Present designs typically incorporate a centrifugal fan or blower, consisting of a wheel with blades on the circumference and a shroud to direct and control the airflow into the center of the wheel and out at the periphery. Motors are mounted on the outlet side of the fan/blower housing. This is done because of cost and to keep them out of the stream of contaminated air. The blades move the air by centrifugal force, literally throwing the air out of the wheel at the periphery, thereby creating a vacuum/suction inside the wheel. Basic design types of wheel blades in centrifugal blowers include the forward curved and backward inclined blades.

Forward curved wheels are operated at relatively low speeds and are used to deliver large air volumes against relatively low static pressures. The inherently light construction of the forward curved blade does not permit the wheel to be operated at speeds needed to generate high static pressures and therefore cannot be used in telescoping downdraft ventilators.

The backward inclined blower wheel design has blades that are slanted away from the direction of the wheel travel. The performance of this wheel, specifically a high efficiency, high cubic feet per minute (cfm) and rugged construction makes it suitable for high static pressure applications. The maximum static efficiency for this type of blower wheel is approximately 75 to 80%. A drawback is that it must be designed for twice the speed, which increases the cost of the unit.

Axial flow fans are also not used for present telescoping downdraft ventilators. This is due to the belief that this type of fan cannot provide the static pressure needed for drawing, its size and spacing requirements. Axial flow fans come in three basic types. The propeller fan (i.e., the house hold fan), the tube axial fan and vane axial fan (cross flow or tangential). The first of these is the most familiar. The propeller fan consists of a propeller blade and associated aperture that restricts blow back from the sides. Without the aperture, the fan is not truly a propeller fan, since it cannot positively move air from one space to another. The aperture is usually sheet metal/plastic designed to fit closely around the periphery of the propeller. The tube axial fan (typically found in computers) is literally a propeller fan in a tube. In this case the tube replaces the aperture. The tube axial fan is an extension of the propeller fan with increased flow quantity, pressure and efficiency, due to the reduced air leakage at the blade tips. The vane axial fan (cross flow or tangential) is a tube axial fan with the addition of vanes within the tube to straighten the airflow. The air flow changes from helical flow imparted by the propeller into a nearly straight line flow. In the process, the vane axial fan increases the pressure and efficiency of the air flow while reducing the noise.

In general the propeller fan operates at the lowest pressure of the three types. The tube axial fan is somewhat higher with the vane axial fan supplying the highest-pressure output of the three. Vane axial fans are noted for use when available space for installation is limited, such as in computers. In down draft ventilation technology, this method of moving air has never been used.

Static efficiencies of 70 to 75% are achieved with vane axial fans. The cfms and static performance range of the vane axial fan is similar to that of a centrifugal. Horsepower requirements are about the same for both designs.

With all present telescoping downdraft ventilators using a centrifugal type fan/blower, airflow is drawn in at a 90 degrees turn to the fan through a small opening and then another 90 degree bend at the cook top surface. The fan/blower is typically located under the counter in the cabinet. The bending of the airflow reduces the suction effectiveness of a telescoping downdraft ventilator using a centrifugal fan/blower. Because of the air stream bending, a large loss of suction occurs, resulting in poor ventilation performance. The best ventilators on the market only capture about 60% of the steam coming off a four-burner cook top. Typically, 100% of steam from the back two burners is captured while only 10% of the steam is captured from the front two burners. Also, a big issue with these centrifugal fan/blower is their noise during operation. These units are very loud and tends to be a problem with present telescoping downdraft ventilators.

Typical telescoping downdraft ventilators only stop at a full-up, or open, position and a full-down, or closed position. Present telescoping downdraft ventilators use mechanical or tactile-type controls to control and operate both the removal of air and the up and down stop points. These mechanical/tactile type controls may be inaccurate and have a tendency to not to work properly. Present designs use knobs and slides to set and control mechanical switches for setting the desired fan/blower speed and stops. These types of products provide an increased rate of failure and other operating problems. The mechanical switches used are inaccurate in their setting and repeatability. These present controls have problems maintaining a set point with swings in repeatedly reaching set points. This is partly due to the design of the telescoping downdraft ventilator and method of drawing air, but also because of the inaccuracy of the mechanical switches themselves. Mechanical control switches have known issues such as hysteresis, which contributes to their inaccuracy in hitting a set point or repeating a function. This can be evidenced by turning the control switch to the right and stop at a set point or turning the same mechanical switch going past the set point and then turning the control to the left stopping at the set point. Both actions end with the same set point selected but the resulting speed will be different. Mechanical levers are used and over time they change positions causing additional problems for the user.

Mechanical switches used in present telescoping downdraft ventilators are subjected to the effects of surrounding environment including heated air, steam, oils, greases, particulates and effluents. Without proper protection these switches cause problems and eventually fail completely. If subjected to cold temperatures, mechanical switches may work slowly, crack, become hard to turn, fail to operate, lubrication can harden causing the operation not to function, cause switch chatter resulting in premature failure or reduced life of product, and cause other user issues. If subjected to hot temperatures, mechanical switches may operate slowly from the lubrication drying out, crack, discolor, become hard to turn, fail to operate, cause switch chatter, cause premature failure or cause user issues when trying to set or operate these controls. If mechanical switches and/or controls are subject to outdoor environments like rain, snow, sun, UV, special sealings are required to prevent intrusion of these environmental conditions that cause premature failure or reduced product life. Special sealed controls used in these environments increases the price of a telescoping downdraft ventilator, mechanical switches and controls when used outdoors in telescoping downdraft ventilator of present design need to be covered, protecting them from the environment. This protection increases the cost for these products and may introduce safety issues.

Present design telescoping downdraft ventilators may use linear tactile electronic control pads, are using tactile type switches with some type of membrane pad over these pads for controlling the functions. The use of tactile switches causes the manufacturer to have to add extensions to these in order to stick out so the user can operate the unit. This addition causes the user to press hard in order to use the rubber or other plastic like material button. This also sets up an area for contamination to get in which can cause problems or failure. In the manufacturing process of these tactile switches, contamination can enter the space, which over time causes problems for the user and sometimes results in failure. In an environment having grease, heat, odor, particulates, and other fluids may cause any type of gap to be filled with contamination. Thus adding an extension to any switch can cause problems for the user both in a build up of contamination but also in the ability to clean. Signs of contamination of build up can be seen around this extension.

No sensors are used to detect the presents of temperature, etc. with these types of telescoping downdraft ventilators. No method of proper airflow detection is provided to the user to indicate the need to change the filter. In fact, the filters on some designs are hidden from view. Other manufacturers have placed a run time and timing out setting as to when the filters should be removed, but this is not or can in fact detect if filters are truly plugged. It is unknown what time it would take for an average use of the filter before it needs replacing or cleaning. For the heavy user the filter would need cleaning sooner and this feature is a problem. For the limited user cleaning is down more often than needed. This is acceptable if the user is using a metal mesh filter that can be washed and replaced, but if the user is using a carbon filter this can get costly.

With present designs, they are limited to islands only, primarily due to their bulky size and lack of room for other appliance below the cook top. With the present units built into an island the ability to provide light is also problem for the user. The present range hood type units are the only ones that provide lighting from above, and a telescoping downdraft ventilator does not provide lighting. Thus the user may have problems using these ventilators because of the lack of lighting. In an island counter installation, the lack of ability to place lights above may exacerbate this problem.

Other issues are presented by present telescoping downdraft ventilators, stemming from the height that these units extend up from the counter top. Some units extend up only 7 inches, where others extend up 15 inches with no adjustability for height. The low extending units provide no effective draw when a large tall pot is place on a burner. They also can blow out the flame on gas burners. On the other hand units that extend 15 inches up provide limited effectiveness when using a frying pan. On some of the taller fixed height units, large filters are used. It has been reported that the drawing air can blow out the gas flame. On ranges with auto sparking for relighting of the gas burners, it has been reported that these ventilators cause continued sparking due in part to the ventilator blowing out the flame. No present ventilators provide varying heights, which would reduce the problems seen by these other units. On the other hand when installing a cook top and wall oven under the cook top the space height can be limited to 8 inches or less. So to have a one-piece telescoping inner member that can rise up to 15 inches is not possible unless you limit the height to less than 7 inches. Again, this is a problem with tall pans with present units.

Quality issues remain with the present telescoping downdraft ventilator operations in their ability to move up and down. Some use a scissor mechanism with many parts, which may jam up, bind, or fail to operate. Also, the operation of these scissors types, are not smooth in movement when moving up or down. They jerk up and down, more like a stepping up or down with stopping in between movements. The use of mechanical switches to detect stopping points for both up and down are used with reliability problems plaguing these units due to the problems associated with mechanical switches and levers. The use of a screw drive unit has been used on high end (i.e., costly telescoping downdraft ventilators) but again they use mechanical switches and levers to detect stopping points for up and down travel and/or elaborate mechanical mechanisms with switches and levers to detect obstructions during travel. These complicated methods may cause additional issues, problems and failure points with costly repair and manufacturing prices.

Present designs are typically for built-in installations on an island counter. Present design are large and bulky. Telescoping downdraft ventilators built into a cabinet on an island counter top and the space below the unit are not available due to the centrifugal blower below and the size of the base housings presently used filling the space. This size limits the telescoping downdraft ventilator from being placed in other areas. This also limits the telescoping downdraft ventilator from being used as a freestanding unit, as a mobile unit, used in a cabinet (e.g., suspended), or in areas that do not have the ability to support a large structural frame. Because of the method of lifting the venting unit cannot be turned upside-down and placed into a cabinet above and have the unit extend down from the back.

Therefore there exists a need for a state of the art telescoping downdraft ventilator in which accurate controlled speed, venting, and removal of contaminates is accomplished in a low, i.e., small, depth installation. There exists the need for an accurate method of controlling the operations and settings. There exists a need for controls to be less susceptible to the environment. There exists a need for the user to be able to view/see the operations, speeds, set points functions, and view the contents on the cook top. There exists a need for a remote control and the controls not using tactile switches. There is a further need to accurately apply and control the height. There also is needed for a new design such that it can be used in other limited spaces and places. There also is needed for the unit to be place in a cabinet above and having the ability to extend down at the back wall or in a cabinet in an island.

SUMMARY AND OBJECTS OF THE INVENTION

The present invention relates to any electronically controlled linear actuator, low depth profile, compact, telescoping downdraft ventilator and more particularly to an improved telescoping downdraft ventilator having better accuracy in removal of contaminated air with precise control of functions/operations and the ability of the appliance to be built in, mobile or modular and fitted into a small depth space. Further, the present invention is thin enough to fit behind a built-in oven in a standard cabinet. The present invention has the ability for the inner cavity to provide lighting to the work surface thus improving visibility of items on a surface. The present telescoping downdraft ventilator also provides almost unlimited height adjustments and speeds. Sensors are incorporated for providing additional functionality. The present invention provides greater efficiency and lower noise and has the ability to be installed behind a wall oven placed in a cabinet below a cook top on a counter.

In one aspect of the invention, a downdraft ventilator preferably includes a housing and an internal member sized to fit within the housing, wherein the housing and the internal member combine to form a duct having an intake opening. Further, the internal member is slidable within the housing so as to be telescoping with respect to the housing. The ventilator also has an actuator operatively connected to the internal member and the housing, wherein the actuator moves the internal member with respect to the housing. The ventilator has a fan positioned at one end of the duct, and it has an electronic control system that controls the actuator and the fan. The electronic control system has a user interface, such as a keypad.

In another aspect of the invention, a downdraft ventilator preferably includes a housing having a top end and a bottom end, and an internal member sized to fit within the housing, with the internal member having an intake opening. The housing and the internal member combine to form a duct, wherein the internal member is telescoping with respect to the housing so as to allow for a portion of the intake opening to extend beyond the top end of the housing. The ventilator also has an actuator operatively connected to the internal member and the housing, with the actuator being configured to move the internal member with respect to the housing. There is a fan located at the bottom end of the housing, and the bottom end has an exit opening. An electronic control system controls the actuator and the fan.

In still another aspect of the invention, a downdraft ventilator preferably includes a housing and an internal member sized to fit within the housing, with the housing and the internal member combining to form a duct. The internal member has an upper end with an intake opening, and the inner member is slidable within the housing so as to be telescoping with respect to the housing and to allow for a portion of the intake opening to extend beyond an upper end of the housing. The ventilator further comprises a plurality of fans positioned at the upper end of the internal member. There is an actuator operatively connected to the internal member and the housing, and the actuator is configured to move the internal member to a desired position with respect to the housing. The ventilator preferably has an electronic control system that controls the actuator and the fan, with the electronic control system having a user interface.

The downdraft ventilator may further include a filter and an air flow sensor, with an air flow limit being stored in the electronic control system to determine when the filter needs to be changed. Additionally, the electronic control system may allow for the user to select a desired fan speed from a range of fan speeds and a desired position for the internal member from a range of positions.

These and other aspects and objects of the present invention will be better appreciated and understood when considered in conjunction with the following description and the accompanying drawings. It should be understood, however, that the following description, while indicating preferred embodiments of the present invention, is given by way of illustration and not of limitation. Many changes and modifications may be made within the scope of the present invention without departing from the spirit thereof, and the invention includes all such modifications.

BRIEF DESCRIPTION OF THE DRAWINGS

A clear conception of the advantages and features constituting the present invention, and of the construction and operation of typical mechanisms provided with the present invention, will become more readily apparent by referring to the exemplary, and therefore non-limiting, embodiments illustrated in the drawings accompanying and forming a part of this specification, wherein like reference numerals designate the same elements in the several views, and in which:

FIG. 11 shows an example of a user interface for use with the present invention.

FIG. 12 shows a perspective view of the user interface of FIG. 11.

Figure 1:
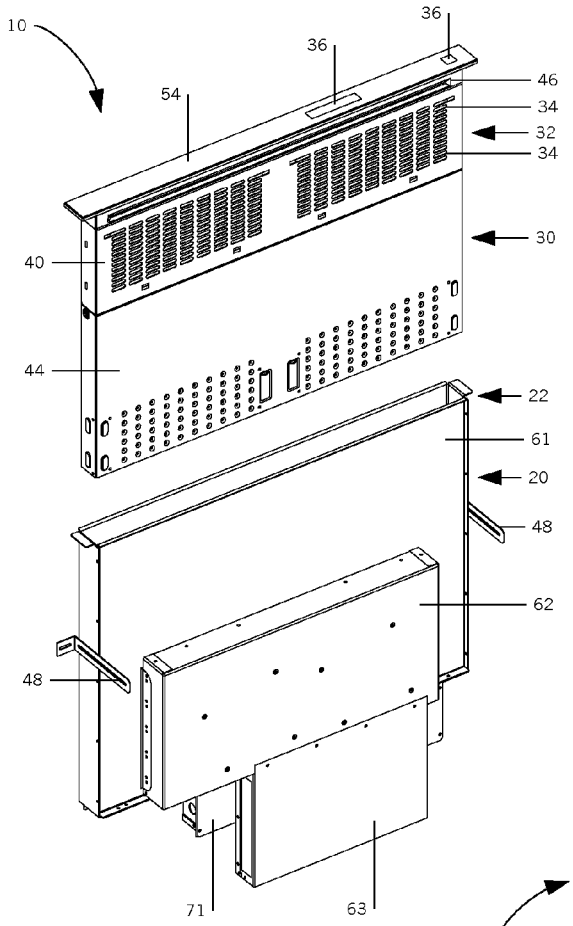
FIG. 1 is a partially exploded view of one embodiment of the present invention.

In describing the preferred embodiment of the invention which is illustrated in the drawings, specific terminology will be resorted to for the sake of clarity. However, it is not intended that the invention be limited to the specific terms so selected and it is to be understood that each specific term includes all technical equivalents which operate in a similar manner to accomplish a similar purpose. For example, the word connected, attached, or terms similar thereto are often used. They are not limited to direct connection but include connection through other elements where such connection is recognized as being equivalent by those skilled in the art.

DESCRIPTION OF PREFERRED EMBODIMENTS

The present invention and the various features and advantageous details thereof are explained more fully with reference to the non-limiting embodiments described in detail in the following description.

1. System Overview

The present invention relates to the ability to remove contaminated air by the use of an improved telescoping downdraft ventilator 10. The telescoping downdraft ventilator 10 can be combined with other counter top range items in the house thus reducing the need for an overhead (i.e., updraft) range hood and increasing available kitchen or cabinet space.

The telescoping downdraft ventilator 10 may be incorporated into or next to a cook top/grill, built into a range, or other appliance having a single to a plurality of heating elements located on a counter or range or other surface. The telescoping downdraft ventilator 10 may be used with gas or electric type heating elements found on appliances to provide proper air removal and may be used with a built-in oven placed under the cook top. The ventilator is preferably composed of a housing 20 and a vertical telescoping inner member 30. Slides, rollers, guide pads (made of plastics, TFE), or other methods for permitting the inner member to be able to slide/guide up or down are incorporated into the telescoping downdraft ventilator 10. The housing 20 is attached to a counter, cabinet, or attached in a range or other surface. See, e.g., FIG. 6*a*. The housing 20 may be attached such that it is the only attached unit and standing alone in free space. No other structure is needed to support this venting system. The inner member 30 may be sealed to the housing 20 to prevent air from leaking. Sealing may be accomplished by seals, such as rubber, tapes or by other methods of closing the gap between the inner member and the fixed base housing. Alternatively, it may be accomplished by metal to metal contact with no seals.

The inner member 30 moves up and down with an actuator 70, which may include a linear actuator (AC or DC) such as a screw drive or a rack and pinion. Actuator 70 may further include any suitable drive mechanism, but preferably the drive mechanism is a motor, and more preferably, it is a spur gear motor (model no. PGM-P30-395 or PGM-P35-555, which can be found at www.power-motor .com, for example). The inner member 30 in the front preferably collapses on itself providing the added extension needed when extending up and to fit in a limited small space when closed. This space is defined from the counter top to the built in oven top. This design permits the telescoping ventilator 10 to obtain a maximum height of about 15 inches. See, e.g., FIG. 6*a*. As shown in FIG. 6B, the inner member 30 is fully retracted so that the trim cap 54 is generally flush with the surface of the cook-top.

As shown in FIGS. 11-16, the invention preferably also incorporates a user interface 36, e.g., a keypad, and an electronic control board 80, which enables adjustment of the fan speeds, elevation height of the internal member 30, and sensors 90, 92. The user interface 36 can be located on the telescoping downdraft ventilator 10, or remotely, or parts of the user interface 36 can be split between the ventilator and other locations. The electronic control board 80 can be located on the telescoping downdraft ventilator 10, or remotely, or parts of the electronic control board 80 can be split between the ventilator and other locations. The internal member 30, driven up and down is controlled by electronic control board 80. This method of control provides the actuator 70 the ability to raise or lower the internal member 30 to a nearly infinite level of height increments. The control board 80 also controls the stopping of the internal member 30 by a user interface 36 by releasing a touch control pad or by detecting an increase in the current, voltage, or resistance during up or down travel. When the internal member 30 strikes or reaches a stop, the current, voltage or resistance increases which is detected by the control board 80 which then determines that a stop/obstruction is reached and turns off the power supply to the actuator 70. Because the design has direct drive in the up and down direction, the unit can be installed in either a ceiling cabinet/wall cabinet for extending down for operation or installed in a floor counter cabinet having the ventilator extending up for operation.

In one embodiment, the ventilator's reduced size allows for greater versatility, for example, cutout dimensions in a cabinet for an oven installed under a cook top for a 24 inch cabinet depth provide that an oven cutout dimension of 28½ inch width, right to left, be cut in the front of the cabinet for a 30 inch oven size. The depth needed by the oven is 23 inches. This leaves 1 inch of space to have a vent system behind an oven. For the oven cut out under a cook top, the width of the cabinet should be 30 inches minimum opening should be 1½ inches from the top of the underside of the countertop for the top opening for the oven. A minimum of 27¾ inches for the cut out height is needed and 5¼ inches from bottom of opening of cut out to the floor is required. The front width, right to left, is 28½ inches. The height from floor to top of counter is 36 inches. Thus, the height from the floor to the bottom of the oven is 4⅝ inches and the cut out is 27¾ inches, which is the top of the oven cut out. This leaves 3.65 inches for the dimension from the top of the counter to the top of the oven, with the depth of a cook top at 4 inches from top of counter extending down into cabinet and a space of 2⅛ inches behind the drop in cook top. While there is insufficient room for a standard venting system, the disclosed new and innovative ventilator fits within this allotted space. This ventilator will be described in greater detail below.

2. Detailed Description of Preferred Embodiments

A. Basic Configurations

With reference to the present invention, FIGS. 1-9 show three embodiments of a telescoping downdraft low depth ventilator.

Figure 2:
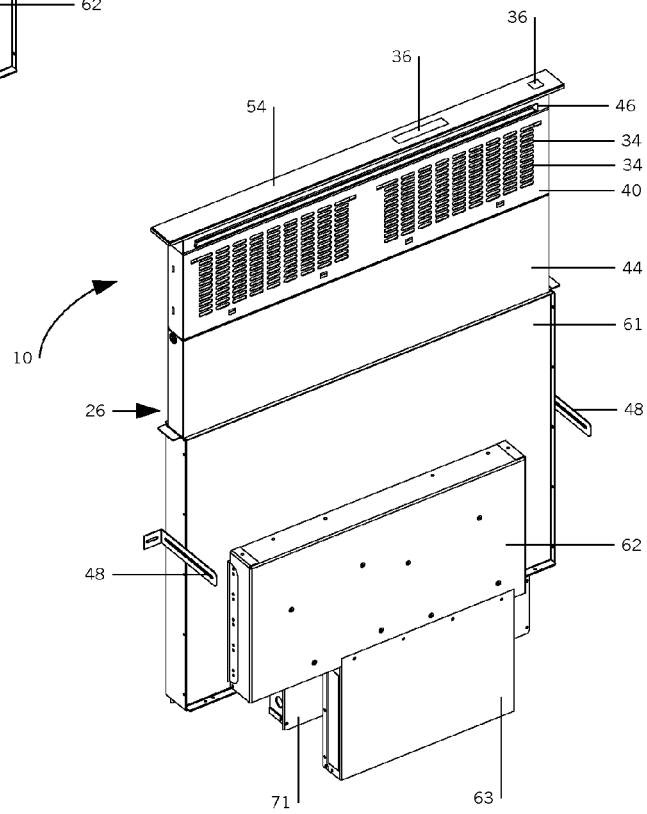
FIG. 2 is a perspective view of the embodiment of FIG. 1.
Figure 3:
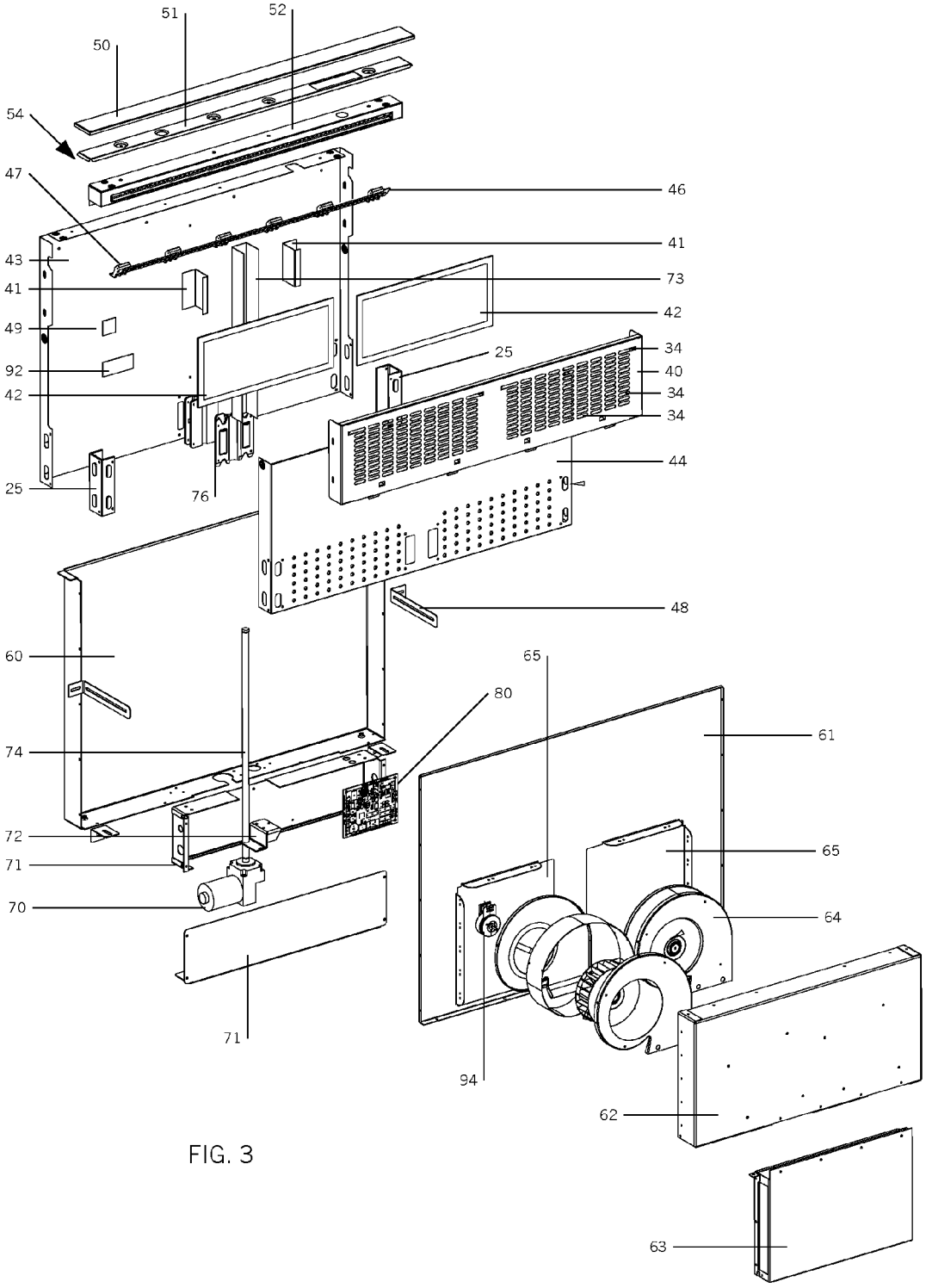
FIG. 3 is an exploded view of the embodiment of FIG. 1.
Figure 3A:
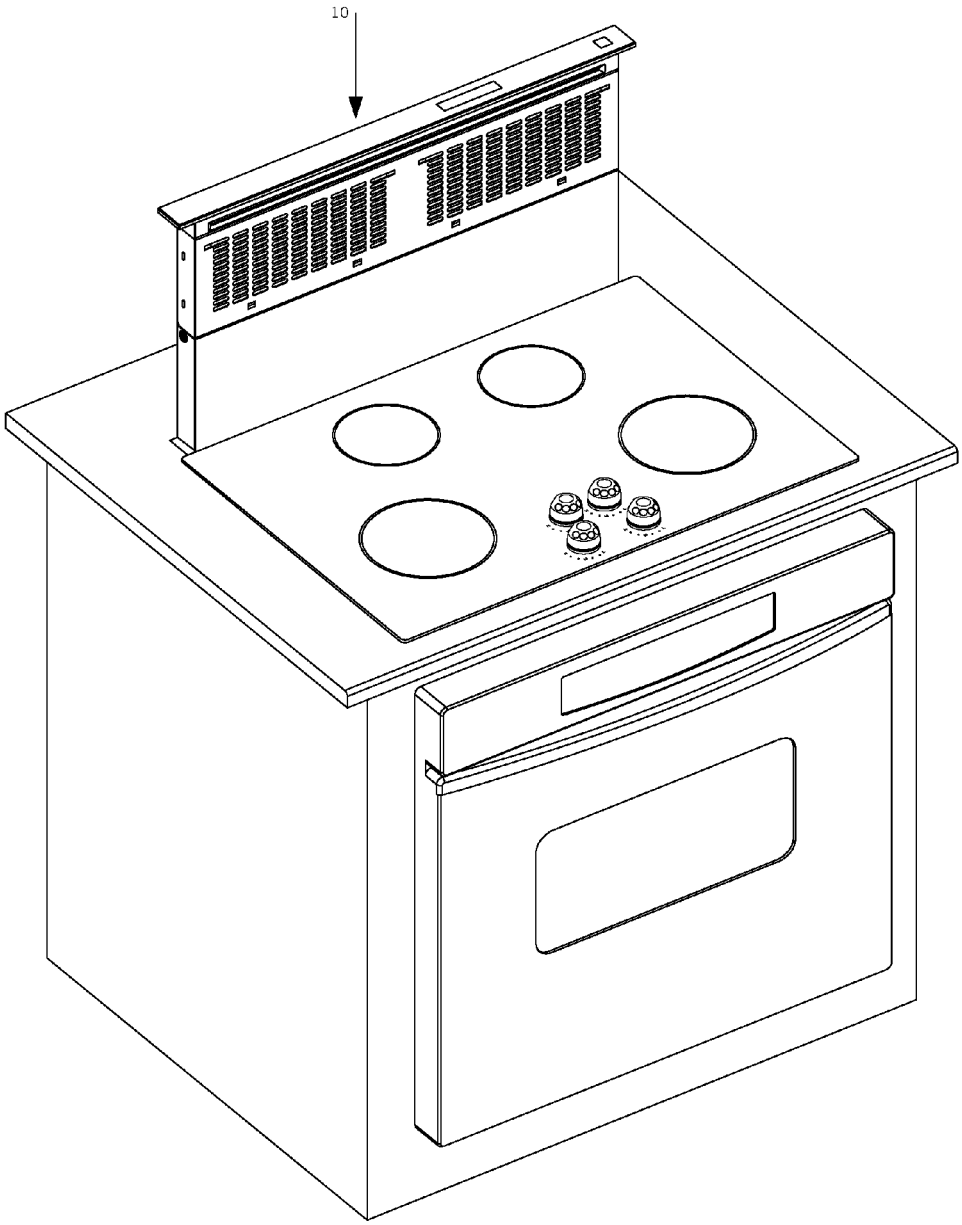
FIG. 3A shows the embodiment of FIG. 1 in combination with an oven/cooktop.

In the embodiment of FIGS. 1-3, the downdraft ventilator 10 includes a housing 20 and an inner member 30, which combine to form a duct 26, as shown in FIG. 2. Inner member 30 is preferably sized to fit within housing 20 so that inner member 30 may be slidable within housing 20, i.e., so that inner member 30 may be telescoping with respect to housing 20.

As shown in FIG. 3, inner member 30 may include a filter panel 40, an inner member channel 44 and an inner member frame 43, which may be assembled using any suitable means, e.g., fasteners such as screws, nuts and bolts, or rivets, to provide structure for inner member 30.

Inner member 30 may also include a filter 42, which may be secured to inner member 30 by filter support 41. Filter 40 may be releasably secured to filter support 41 by any suitable means that will allow for easy replacement of filter 40 when replacement becomes necessary. The ventilator 10 may also include air flow sensor 49, which may be positioned within inner member 30. Air flow sensor 49 may detect the air flow through the filter 42. When the air flow is at or below a certain pre-determined limit, air flow sensor may communicate with electronic control system 80, which then may indicate to the user that the filter 42 may need to be replaced.

The upper end 32 of inner member 30 may be equipped with trim 50, a trim base 51 and header bar 52, which may be assembled to form trim cap 54, as shown in FIG. 3. Trim 50 may also include lighting system 46, which may be attached to trim 50 using mounting block 47.

As shown in FIG. 3, housing 20 may include a housing frame 60, a blower panel 61, a blower box 62, and a discharge body 63, which may be assembled using any suitable means, e.g., fasteners such as screws, nuts and bolts, or rivets, to provide structure for housing 20. Air may be discharged through discharge body 63, e.g., through an exit opening, and preferably into an exhaust vent.

Housing 20 may also include a fan 64, which may be located within blower box 62. Blower panel 61 may have an opening 65 to enable fan 64 to bring air in through intake opening 34, move the air through duct 26, and discharge the air through discharge body 63.

Housing 20 may also include an actuator 70. Actuator 70 may be connected to an actuator support 71 by actuator bracket 72. Actuator 70 may include a rod 74, which is located within track 73, attached to inner member 20. Accordingly, actuator 70 may cause inner member 30 to slide up or down, i.e., to telescope, with respect to housing 20.

In addition, ventilator 10 has an electronic control system, which is preferably stored on electronic control board 80. As shown in FIG. 3, electronic control board 80 is preferably located within housing 20.

Figures 4, 5:
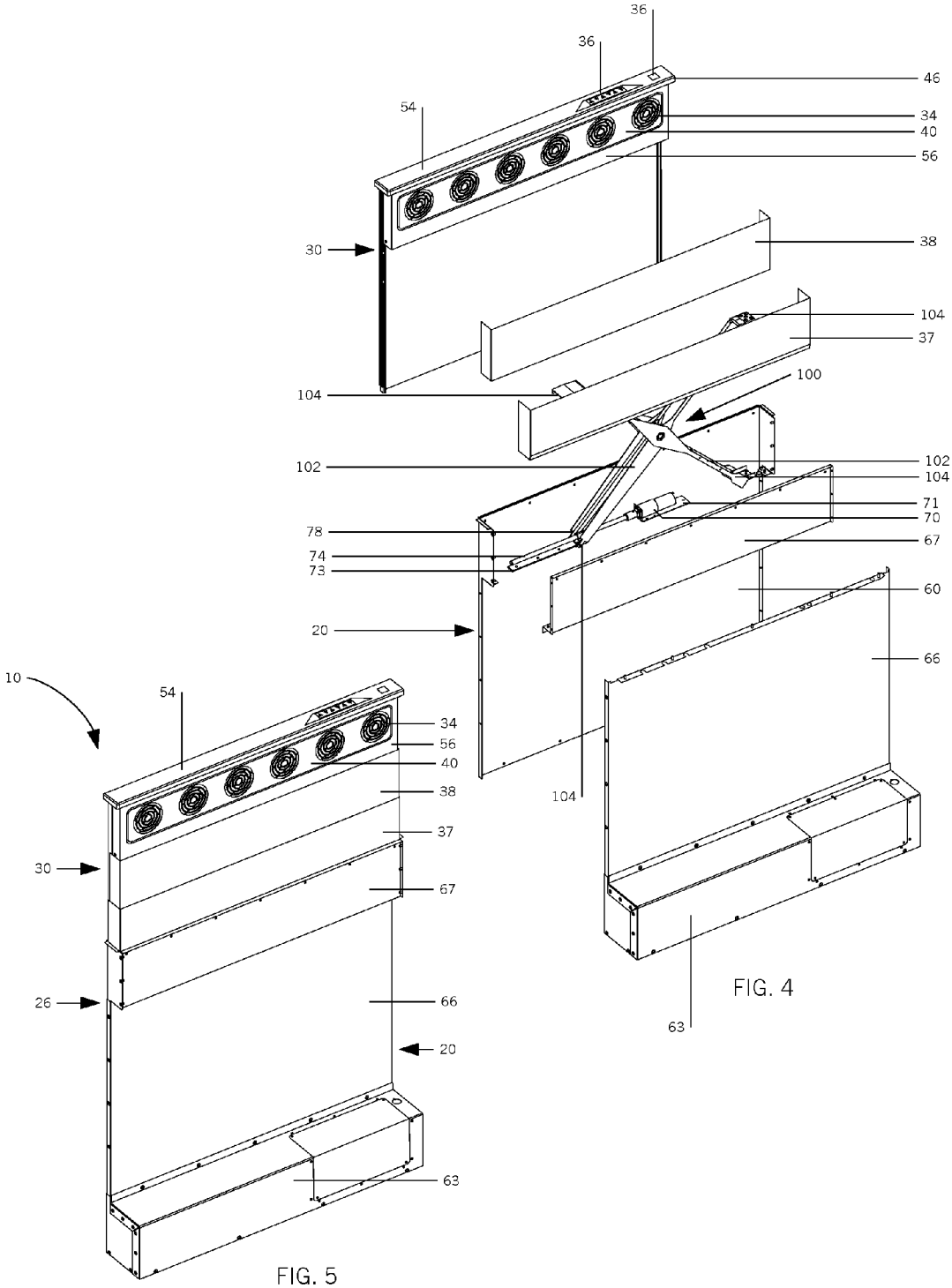
FIG. 4 is a partially exploded view of another embodiment of the present invention.
FIG. 5 is perspective view of the embodiment of FIG. 4.
Figure 6:
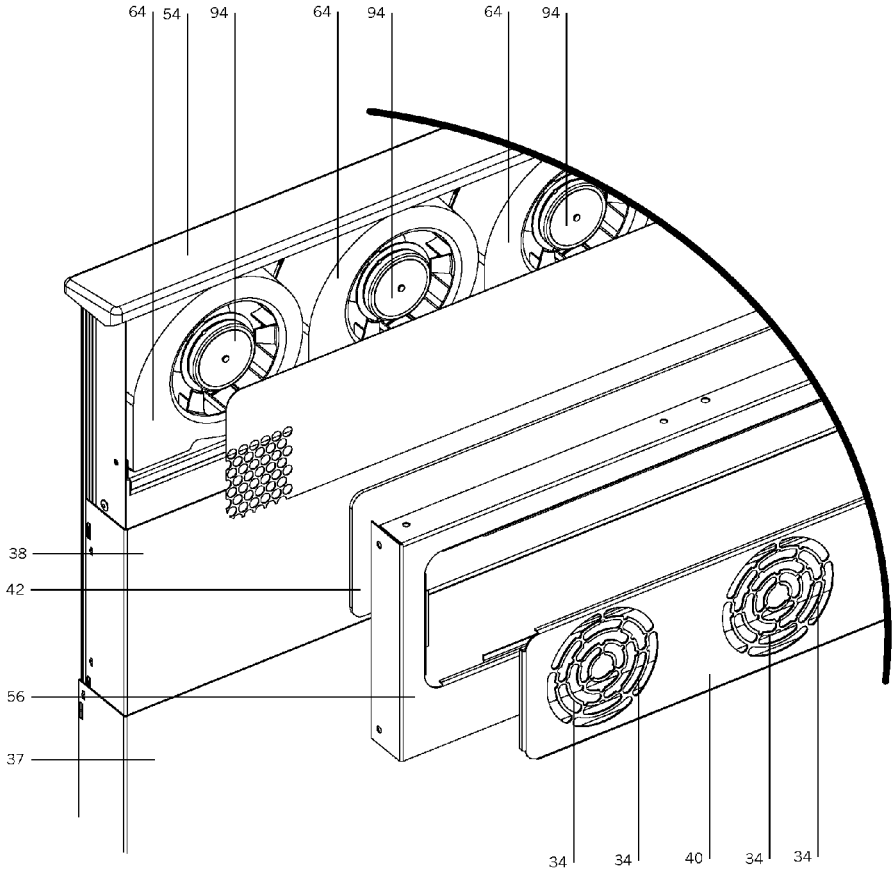
FIG. 6 is an enlarged perspective view of the embodiment of FIG. 4.
Figure 6A:
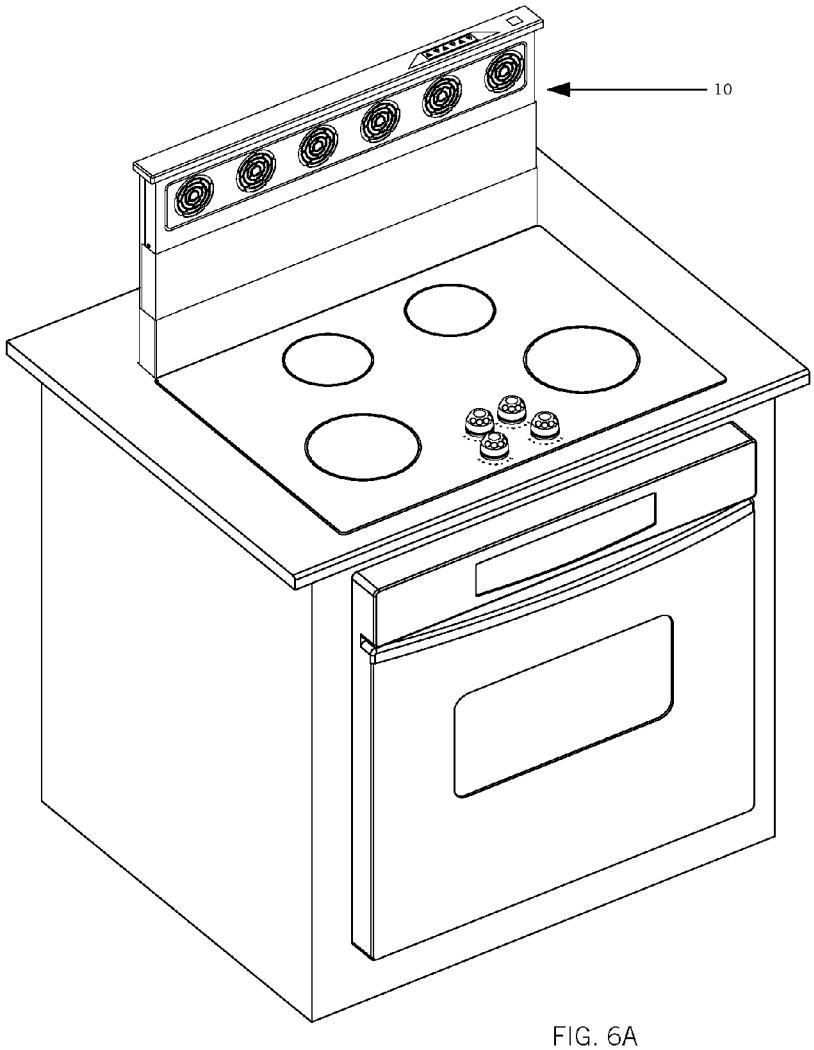
FIG. 6A shows the embodiment of FIG. 4 in combination with an oven/cooktop.
Figure 6B:
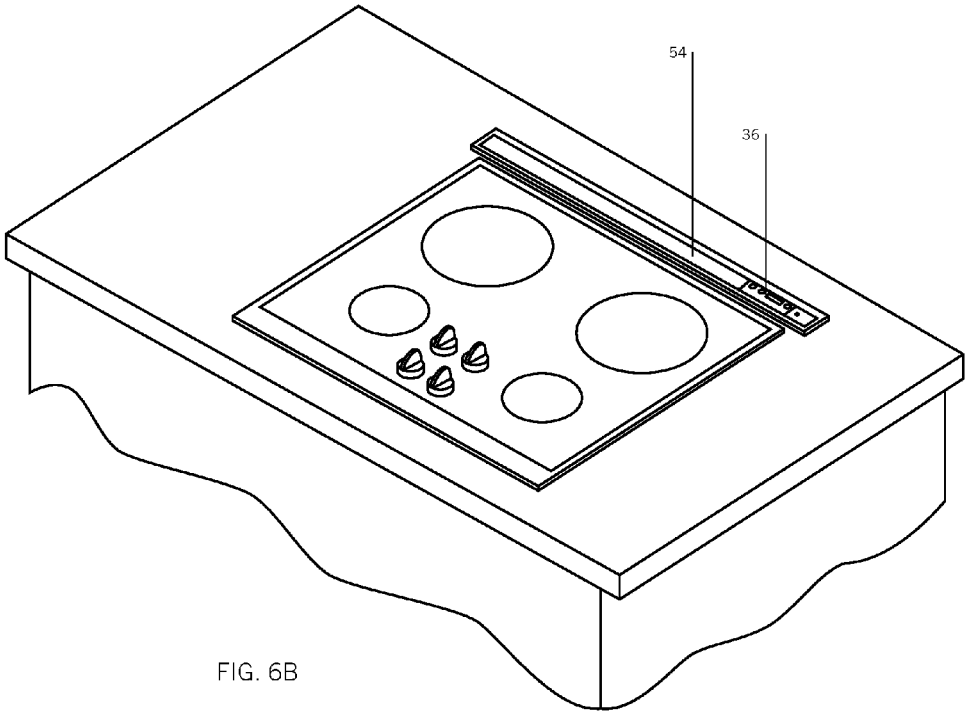
FIG. 6B shows the embodiment of FIG. 1 in a fully retracted position.

Another embodiment is shown in FIGS. 4-6. Here, ventilator 10 has a plurality of fans 64 located at the upper end 32 of inner member 30. In this embodiment, it is preferred that each of the plurality of fans 64 is a centrifugal blower.

As shown in FIG. 6, inner member 30 may also include a filter panel 40 and a filter 42, which may be secured to inner member 30 using inner member front panel 56. The plurality of fans 64 is positioned at the upper end 32 of the inner member 30, behind the inner member front panel 56, the filter panel 40, and the filter 42.

Referring now to FIG. 4, actuator 70 is secured to housing frame 60 and housing frame front panel 67 by actuator support 71. Actuator 70 may include a rod 74. Rod 74 may be generally aligned along track 73, which in turn may be attached to housing frame 60 and housing frame front panel 67. Slide nut 78 is slideably attached to track 73. Slide nut 78 is able to move up and down rod 74, which may have threads to engage slide nut 78. As the rod 74 turns, slide nut 78 moves in one direction, while turning rod 74 in the opposite direction causes slide nut 78 to move in the other direction.

As shown in FIG. 4, slide nut 78 is operatively connected to scissor linkage 100. Scissor linkage 100 has two legs 102, each of which has a foot 104. One foot 104 is attached to slide nut 78, while the other three feet 104, 104, 104 are connected to the inside of the downdraft ventilator 10 so as to allow for legs 102, 102 to expand and contract. For example, two feet 104, 104 may be rigidly secured to the inside of downdraft ventilator 104, while the other foot 104 (preferably the foot directly above drive nut 78) may be slidably attached, e.g., along a track.

When actuator 70 turns rod 74, slide nut 78 moves along rod 74. This causes the scissor linkage 100 to either expand or contract depending on the direction in which slide nut 78 is moving, thus causing inner member 30 to move up or down. Accordingly, actuator 70 may cause inner member 20 to slide up or down, i.e., to telescope, with respect to housing 30.

As shown in FIG. 4, housing 20 may include a housing frame 60, a duct panel 66 and a discharge body 63, which may be assembled using any suitable means, e.g., fasteners such as screws, nuts and bolts, or rivets, to provide structure for housing 20.

In addition, the embodiment of FIGS. 4-6 may include an electronic control board 80, which may be located within housing 20.

Figure 7:
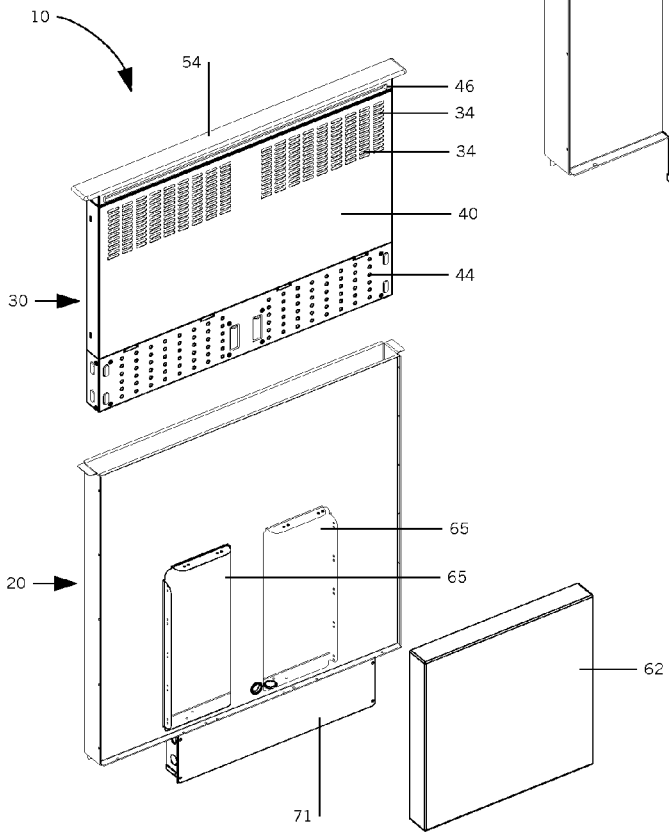
FIG. 7 a partially exploded view of yet another embodiment of the present invention.
Figure 8:
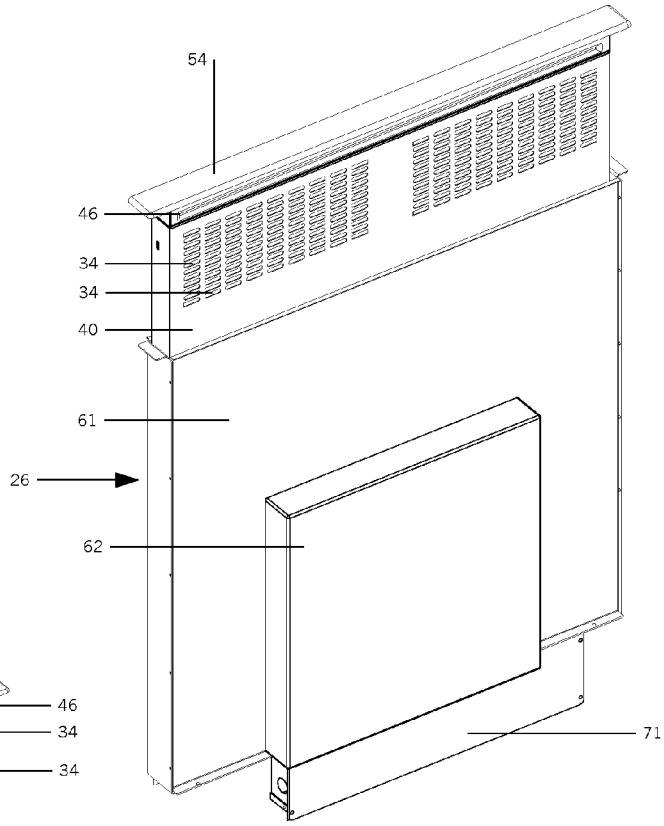
FIG. 8 is a perspective view of the embodiment of FIG. 7.
Figure 9:
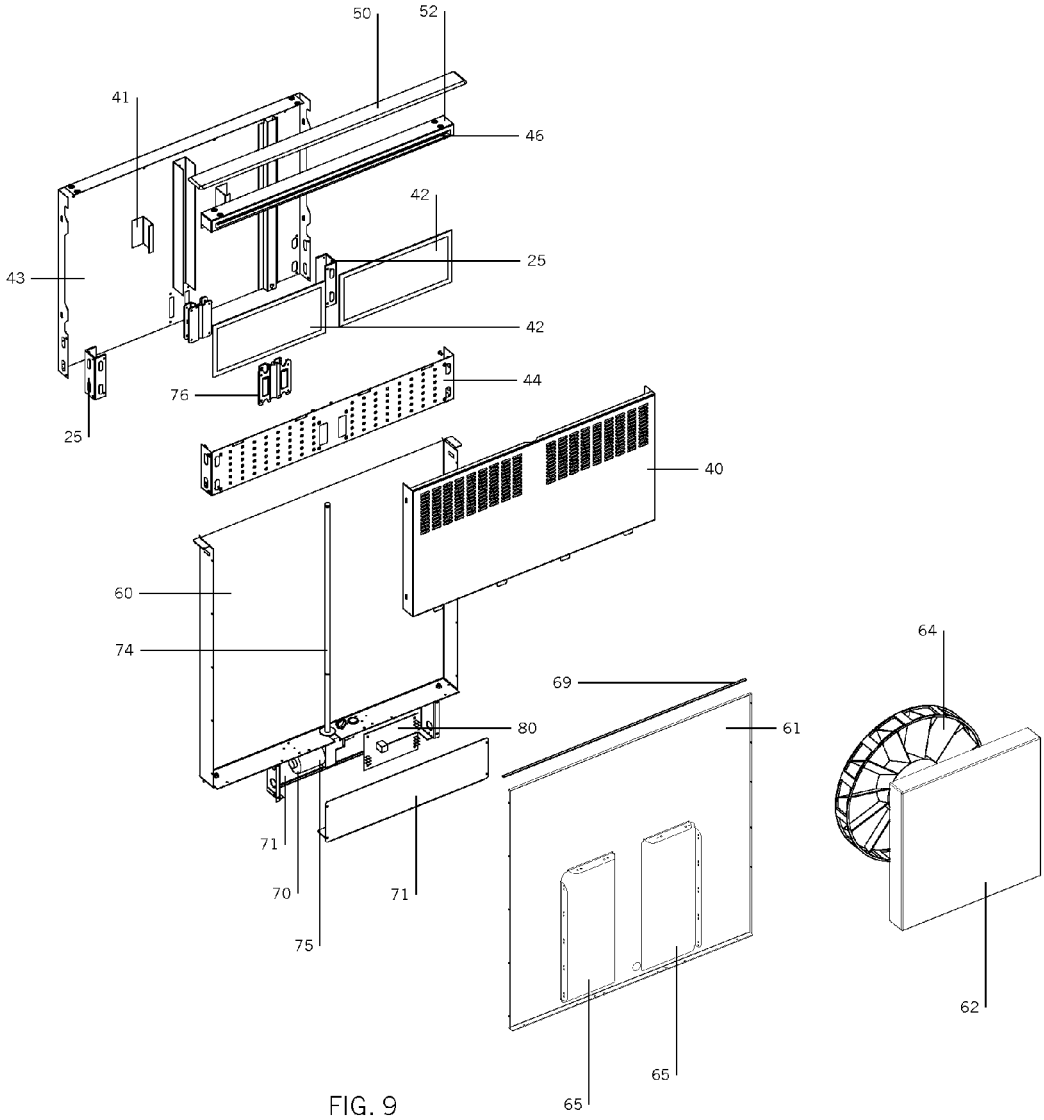
FIG. 9 is an exploded view of the embodiment of FIG. 7.

In another embodiment of the present invention, the low depth telescoping downdraft ventilator 10 of FIGS. 7-9 includes a housing 20, a top trim cap 54 and a telescoping downdraft ventilator inner member 30. The inner member 30 has an intake opening 34 for air to be drawn in. A linear lift drive actuator 70 is also provided and is composed of a motor 75 and a threaded type rod 74 or gear rack. These items, motor 75 and rod 74 may be one assembly or separate components. These two items provide the ability to move the inner member 30 up and down with respect to housing 20. Seal 69 provides sealing for the space between the housing 20 and inner member 30. Seal 69 may be made of any suitable material, such as insulation, foam, rubber or plastic. The seal 69 also makes contact with the inner member 30 to provide sealing as inner member 30 moves up and down. This provides better air loss control, for example, when using two-wall construction.

The exploded view shown in FIG. 9, is similar to the exploded view of a different embodiment of FIG. 3. The primary difference is type of fan 64 that is used.

There are many ways to construct a telescoping downdraft ventilator box and there can be any number of forms and styles used for the inside or the outside based on this invention.

For example, only an inner cavity wall type for moving the unit up or down is shown in FIGS. 1-3. This method alternative can be used as long as the surrounding surfaces can take the movement and not be interfered with. This method provides a lower cost of manufacturing. This single box moves up and down with all the parts attached. A guide mechanism guides the unit up and down from the outside. An actuator 70, e.g., a linear screw drive provides the lifting of the inner member 30. One advantage to using this method is that there is no base housing to contend with and therefore no sealing from the base housing to the inner member is needed.

Further, the telescoping downdraft ventilator may consist of multiple cavities or compartments in the same appliance or multiple fans/blowers as shown in FIGS. 1-9. The fan/blowers may be placed in different locations. For example, in the embodiment of FIGS. 4-6, the plurality of fans 64 is mounted in the inner member 30 and close to the intake opening 34 for better removal and better efficiency. In another embodiment, e.g., the embodiment of FIGS. 7-9, the thin fan 64 is located in the housing 20.

With reference to the present invention, the telescoping downdraft ventilator may replace the slides with a plastic or slippery material such as nylon, TFE, delrin, etc. attached to the stationary housing is disclosed. See FIGS. 7-9. Strips or extruded shape of slippery material are preferably locked into place on the front, back, and sides of the housing provide the guiding and positioning of the inner member 30 as it moves up or down. Locking can be by the method shown but also can be by adhesive.

For example, as shown in FIG. 9, guides 25, 25 are located on the housing 20 to position the inner member 30 and keep it straight. Guides 25, 25 may be positioned at the upper end 22 of the housing 20. Guides 25, 25 may provide a reduced frictional surface for guiding the inner member 30 as it is extends beyond housing 20. Guides 25, 25 may be of any suitable design and material. Guides 25, 25, may also include nylon pins.

B. Additional Features

The following are additional features and/or systems that may be included in any of the embodiments discussed above.

1) Fan/Blower

With reference to the present invention, the above described ventilator 10 preferably includes a fan 64 which is driven by fan motor 94. The various embodiments discussed above incorporate a low profile (i.e., thin) fan assembly, which improves air removal through duct 26. See FIGS. 3, 6 and 9, for example.

In accordance with this invention, fan 64 (or plurality of fans 64) may be any number of low profile fans, e.g., centrifugal fan or blower (including forward curved blades or backward inclined blades), axial flow fan (including propeller fan, tube axial fan, and vane axial fan). In another example, muffin fans may be used, which can be formed and bent into a desired shape or position.

Similarly, any number of fan motors 94 may be used to drive the fan 64 in connection with the present invention. Preferably, the fan motor 94 is an EC 45 F Maxon motor USA (model no. 251601).

Fan 64 may be a single fan, see FIG. 9, or a plurality of fans 64. See FIGS. 3 and 6. Fan 64 may be placed at a variety of locations, including the bottom, the walls, the top, the front, and in the back of the telescoping downdraft ventilator 10, or at any combination of these locations. Preferably, the fan 64 or plurality of fans 64 is positioned near the intake opening 34 to provide better draw of air into the duct 26, as shown in FIG. 6. Placing the fan 64 as close to the items on a cook top location as possible, e.g., near the upper end 32 of the inner member 30, increases the effectiveness of removing contaminated air from the cook-top.

Electronic control board 80 may be used to control fan 64 or plurality of fans 64, which may greatly improve the removal of contaminated air. Improved control of the fan 64 also means less loss, less noise and smaller overall size (which may enable the appliance to be combined with a variety of cook-top designs, e.g., cook top drop-in style and built-in in an island or wall cabinet).

In another aspect of the invention, the number of bends in the base housing and the inner member are reduced to reduce air flow losses. For example, FIGS. 2, 5 and 8 show duct 26, which does not cause the air stream to change directions, i.e., the duct 26 provides a relatively straight path for the air flow, as opposed to present designs which may change air flow direction at least twice. This increase in effectiveness permits the size of the fan 64 and fan motor 94 to be reduced. Thus, the noise level of the downdraft ventilator 10 may be reduced.

The use of a plurality of fans 64, as shown in FIG. 6, may provide advantages over current designs, including wide uniform flow of air over the width of the unit without gaps, uniform air delivery for high capacity and wheel geometry resulting in a significantly quieter fan 64.

Ventilators with multiple fans can save energy by operating only the fan or fans that are needed to remove the contaminated air. The speed of the fan 64 may be regulated by using resistors, regulating transformers and electronic controllers for voltage regulation to provide even more control. For example, the electrical current to the blower motor can be controlled such that the power output can be increased or decreased to change the air output accordingly. This provides the ability of a telescoping downdraft ventilator to detect the airflow draw needed to overcome each burner and the necessary draw for contaminated air removal.

Additionally, lower profile fans provide a smaller profile for the same length of exterior housing resulting in a very low profile as small as ½ inch depth. This smaller profile may provide more useable room under a range/cook top or in a cabinet.

Other advantages are as follows: design for overload protection, no warming of the air, as the motor is situated outside the airflow, long bearing life, and high efficiency.

Further, using more than one fan 64 can provide the user the ability to configure the draw zones in a telescoping downdraft ventilator. See FIGS. 4-7. The energy savings from not having to turn on a large blower motor provides added benefits to the user in the way of cost savings.

In sum, using a low profile fan may be two or even three times more efficient than designs that are presently used.

2) Control Board

Figure 14:
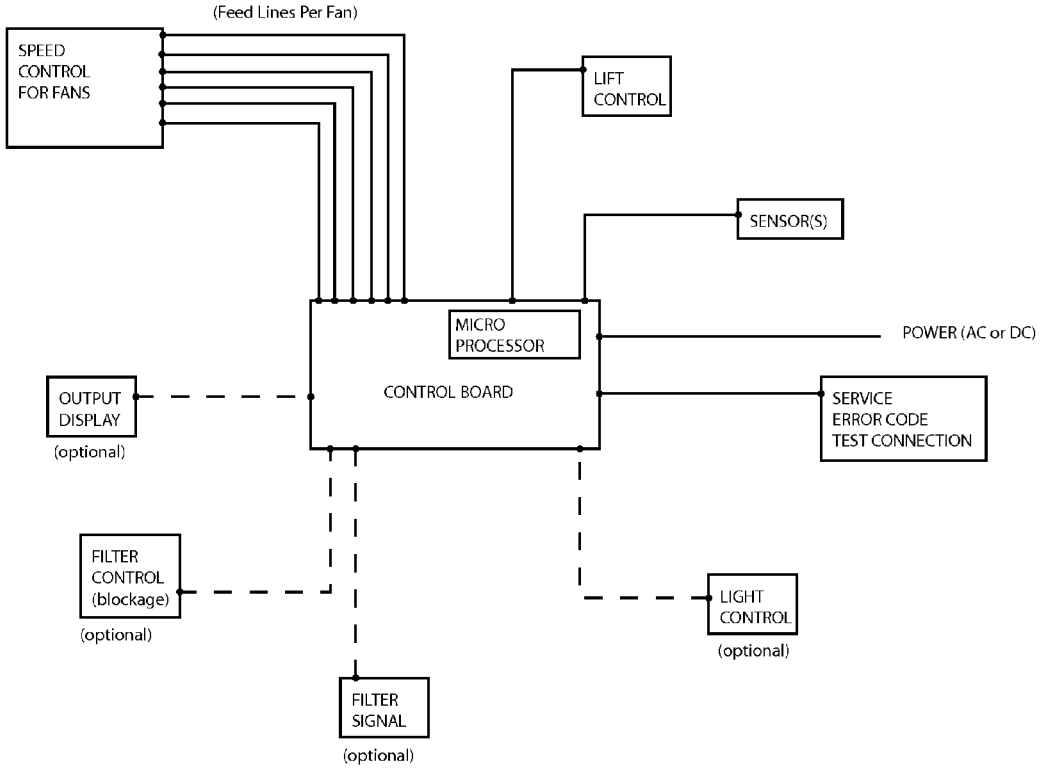
FIG. 14 shows a schematic layout for the electronic control system for use with the present invention.

With reference to the present invention, the ventilator 10 preferably includes an electronic control system 79 which may be implemented by electronic control board 80 shown in FIGS. 3 and 9. The control board 80 provides the power and control to the actuator 70, to the fan 64 or plurality of fans 64, 64, to the fan motor 94, to the user interface 36, and to the sensors 49 and 92, for example, as shown in FIG. 14. An AC/DC power cord supplies power to the control board 80. The control board 80 can be located on the ventilator or remotely, or it can be divided into more than one board at different locations. The control board 80 also can incorporate flex technology, which permits the control board 80 to bend, thereby providing greater flexibility than hard flat electronic boards. This can be of use if the desired positioning of the control board 80 requires control board 80 to be bent around a corner.

3) Filter

With reference to the present invention, inner member 20 preferably houses the filters 42, 42, which may be positioned near intake opening 34 as shown in FIGS. 3, 6 and 9. There is a number of ways to attach filter 42 as is well known by those skilled in the art. As shown in FIG. 3, filter 42 is attached to the downdraft ventilator 10 using filter brackets 41, 41.

4) Flow Sensor

In another aspect of the invention, the telescoping downdraft ventilator 10 has a flow sensor 49 behind the filter 42 for detecting airflow through the duct 26, which can greatly improve on the servicing of the filter 42. A flow sensor 49 behind the filter 42, which is in communication with the electronic control board 80, detects the movement or reduced movement of air passing by the flow sensor 49 and through the duct 26.

The air flow through the duct 26 can be compared with a predetermined limit stored on control board 80 to determine when the filter 42 needs to be exchanged. These limits can be adjusted for the type of filters used, e.g., metal mesh, louvers, carbon filters or a combination of these types. In an alternative configuration, the electronic control board 80 sets the limits automatically by setting a percentage of blockages in the filter 40.

The flow sensor 49 for airflow can range from the simplest and lowest cost types such as the strain gage on a reed, in which the air moving across the reed bends the reed causing the strain gage to send a signal to the electronic control board 80. As the air flow is reduced due to blockage in filter 42, the signal changes and the electronic control board 80 can signal the user, e.g., via user interface 36, to change the filter. Signaling the user can be accomplished through sound, lights or other methods such as the ventilator not operating.

Another low cost sensor that may be used is a magnetic sensor. This type of sensor operates very similarly to the strain gage/reed assembly, but the magnetic sensor detects a magnetic gain or loss. Another sensor type is the differential pressure sensor, which has one open end on the outside of the filter 42 and the other end behind the filter 42. The pressure difference between the sensor openings can be signaled to the electronic control board 80, which then can signal for a filter change when a set point is reached.

Another sensor that may be used is the microbridge mass airflow sensor, which operates on the theory of heat transfer. Mass airflow is directed across the surface of the sensing elements. Output voltage varies in proportion to the mass of air or other gas flowing through the inlet and outlet ports of the package. The specially designed housing precisely directs and controls the airflow across the microstructure-sensing element. The microbridge mass airflow sensor uses temperature sensitive resistors deposited within a thin film of silicon nitride. The resistors are suspended in the form of two bridges over an etched cavity in the silicon. The chip is located in a precisely dimensioned airflow channel to provide a repeatable flow response. Highly effective thermal isolation for the heater and sensing resistors may be attained by etching the cavity space beneath the flow sensor bridges. The small size and thermal isolation of the microbridge mass airflow sensor are responsible for the extremely fast response and the high sensitivity to flows. The design of a microbridge mass airflow sensor has a unique silicon chip based on advanced microstructure technology. It consists of a thin film, thermally isolated bridge structure containing heater and temperature sensing elements. The bridge structure provides a sensitive and fast response to the flow of air or other gas over the chip. Dual sensing elements positioned on both sides of a central heating element indicate flow direction as well as flow rate. Laser trimmed thick film and thin film resistors provide consistent interchangeability from one device to the next.

Further, sensor 49 may be a variety of other types of flow sensors including Mass flow, Solid State Hall effect sensors, Piezoresistive sensors, calibrated pressure sensors, transducer, bonded element transducers, transmitters, ultrasonic, Doppler, IR, and Fiber Optic Sensors.

5) Blower/Fan Speed Control

The ability to better regulate the electrical current to the low profile fans 64 such that the power output can be increased or reduced with improved accuracy, and similarly increasing or decreasing the speed output from the fan 64 with greater accuracy is provided. Present products cycle electrical current off and on, having the fan 64 provide full speed power and then complete power using resistance in limited steps in attempt to reach and maintain a desired speed. In contrast the present invention can determine the needed airflow loading for the inner member 30 and only supply that required amount of power. This method can satisfy the criteria for the Energy Star® rating used for improved energy use.

Figure 13:
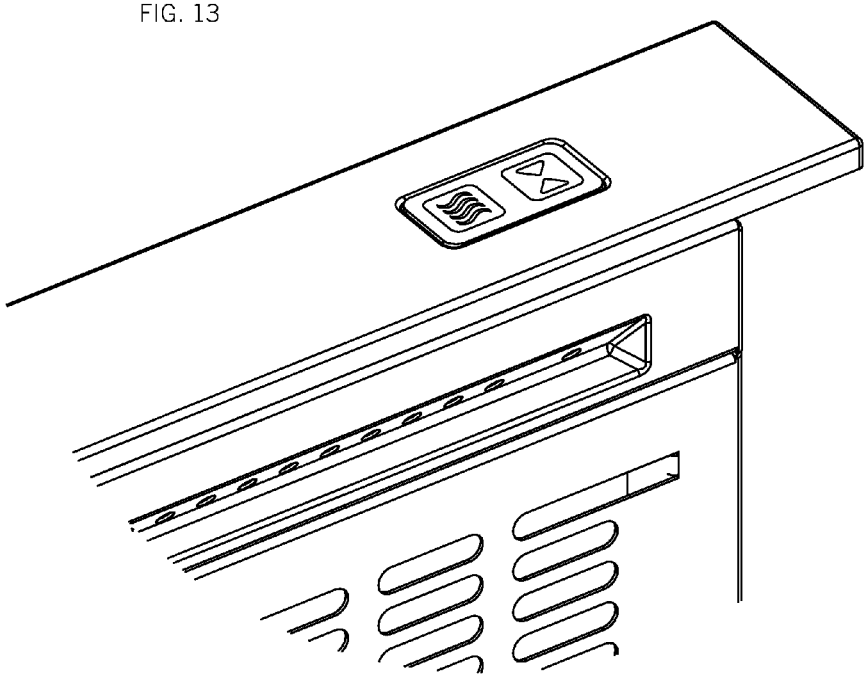
FIG. 13 shows another example of a user interface for use with the present invention.

Another aspect of the present invention is to have a nearly infinite range of selectable speed adjustments. This may be accomplished by having the user touch down on a user interface 36, e.g., a glass resistance keypad, until the desired speed is reached. Then, up to the user releasing his finger from the user interface 36, the electronic control board 80 reduces power to the fan 64 to slow or stop the fan 64. The user interface 36 can have one or more keypad locations for increasing or decreasing the speed of the fan 64. For example FIGS. 11-13 and 16 show a keypad having two buttons per function, e.g., one button to increase fan speed and one button to decrease fan speed. In another example, FIG. 13 shows a keypad having only one button per function. Using two or more locations for independent operations (as shown in FIGS. 11-13 and 16), e.g., increasing or decreasing fan speed, provides better control and is less complicated for the user. A display to show the speed level of the fan 64 can be used to assist in finding desired speeds, which then can be programmed into the electronic control board 80 for repeated operations later.

6) Electronic Display/Touch Control Panel

The ability to display to the operator the operations, functions, speed, filter life/change, and times using electronics and lighting, and to accurately control these operations will advance the ability to remove contaminated air. Electronic control board 80 is one type of electronic control, as shown. Additionally, electronic control board 80 could be divided into more than one electronic boards or display boards. Knobs can be used to interface with the electronics, thus providing the look of a mechanical product. Construction of the electronics in a telescoping downdraft ventilator can use, but is not limited to: high heat construction design; specialized adhesive construction; use of loop resistant circuitry; ESD/EMI/RFI shielding; electronics, and using LED, LCD, Plasma, dot matrix, or vacuum fluorescent displays. All of these can improve the control, display, design, look, and operation of the electronics.

User interface 36 may be an electronic touch control panel such as a Piezo, capacitance, resistance, or inductive electronic touch panel (keypad) that enables the user to select an operation. Any of these touch panels or keypads may be made of glass, metal, plastic or a combination thereof, such that an operation is selected by touching the surface of the panel or keypad, thereby creating or changing an electronic signal that is measured and responded to by the electronic control board. Any switches contained therein may be fitted with decorative overlays, under coatings, or labels in a completed control panel assembly. These electronic touch control panels or keypads may be employed on any size telescoping downdraft ventilator. Micro controllers, IC's and drivers, PC boards, processor and power, or other electronics can be used in conjunction with electronic touch controls or keypads to permit the operation of various components within the telescoping downdraft ventilator.

User interface 36 can be installed flush, raised, or recessed with the use of these types of electronics. Touch control keypads can be installed in any plane or on any surface with the use of electronics. This can be done to accommodate any design for matching or simulating the look of other devices the telescoping downdraft ventilator may be paired with. Touch control keypads or displays can be placed on the front or top of the inner member 30 thereby providing for the operator to view the information pertaining to the operations and functions without having to open up the telescoping downdraft ventilator.

The user interface 36, e.g., touch control panel keypad, can be remotely controlled having the electronics or a portion of the electronics located not on the product, but in a different location not on the telescoping downdraft ventilator 10. Remote control may use wires (or it may be wireless) to control the functions of a telescoping downdraft ventilator 10. Keypads can have graphics specific to the design for the mating products or specific to the required designs and functions. The use of electronics provides better control and offers more flexible operations than can be had in a mechanical control. With this flexibility the operator can see what is happening and can modify the functions of the telescoping downdraft ventilator to achieve what performance is desired.

The appearance of the electronics may be made to match other looks on appliances. Similarly, the overall size, design, look, and feel of a telescoping downdraft ventilator may be matched to the size, design, look, and feel of any appliances.

7) Controlled Stop Points

According to another aspect of the present invention, a ventilator 10 has the ability to move up and down without the use of mechanical switches to control its ability to stop. The electronic control board 80 monitors the current, voltage or resistance to determine the stopping point of the inner member 30. The actuator 70 raises the inner member 30, and when the inner member 30 reaches full extension, it contacts a stop, e.g., a fixed stopping flange, on the housing 20. When the actuator 70 tries to move the inner member 30 up, the demand for more current is drawn from the electronic control board 80. The electronic control board 80 detects that an increase in current is required for the actuator 70 to continue to drive the inner member 30 up and turns off power to the actuator 70, thus stopping any movement up. This method of movement similarly occurs for the downward movement where the trim cap 54 acts as the stop point and the electronic control board 80 detects an increased current draw from the actuator 70. This may also occur if the inner member 30 is obstructed from moving up or down.

Additionally, the electronic control board 80 may be used to detect voltage or resistance (as opposed to current) from the actuator 70 as inner member 30 reaches stop points. Examples of sensors that may be used on the electronic control board 80 include: Current sensors that monitor AC or DC current, adjustable linear, null balance, digital, and linear current sensors, magnetoresistive, closed loop current sensors, digital current Sensors and others.

8) Nearly Infinite Range of Selectable Heights

Another aspect of the present invention is to have a nearly infinite number of selectable height adjustment levels. This may be accomplished with the user interface 36, e.g., by pressing a button on a glass resistance keypad, until the desired height is reached. Once the height is reached the electronic control board 80 cuts power to the actuator 70, which stops the height adjustment 36, e.g., when the user releases his finger from the keypad. The user interface 36, e.g., keypad, can have one or two locations for operating up or down by the user, i.e., one button for up and one button for down. See, e.g., FIG. 11. Using two locations for independent operations can provide user better control by being simple. Additionally, a display may be used to indicate the height level of inner member 30, which then can be programmed in for repeat operations.

9) Display Mounting Location

According to another aspect of the present invention, the user interface 36, which may have display and control functions, could be mounted to the fixed faceplate or the movable trim cap 54 of a telescoping downdraft ventilator 10. With the displays or functions mounted on the trim cap 54 with the telescoping downdraft ventilator closed, viewing of the displays and or controls can be seen as to what the operations read outs are set. This permits the user the ability to view the settings and make changes without opening the telescoping downdraft ventilator 10. Electronics mounted on side faces of a telescoping downdraft ventilator can be disconnected when the ventilator is pulled down disconnecting functions, by wireless communication, or by wires not disconnecting operations so as not to interfere with the operation of the telescoping downdraft ventilator being opened. A contact touch pad may be used for activating the display.

Using nearly infinite height adjustments for the inner member 30 and nearly infinite fan speeds may provide the user with the ability to configure the draw zones in the ventilator 10. For example, the user may be able to remove contaminated air by positioning the inner member 30 at the optimal height level. This may also enable a speed reduction in the fan, which in turn may reduce the noise level and the cost of operating.

10) Lighting

The ventilator 10 of the present invention may also be equipped with lighting to illuminate the surface of the cooktop. Many current designs of ventilators for use in combination with an island do not have lighting.

Figure 19:
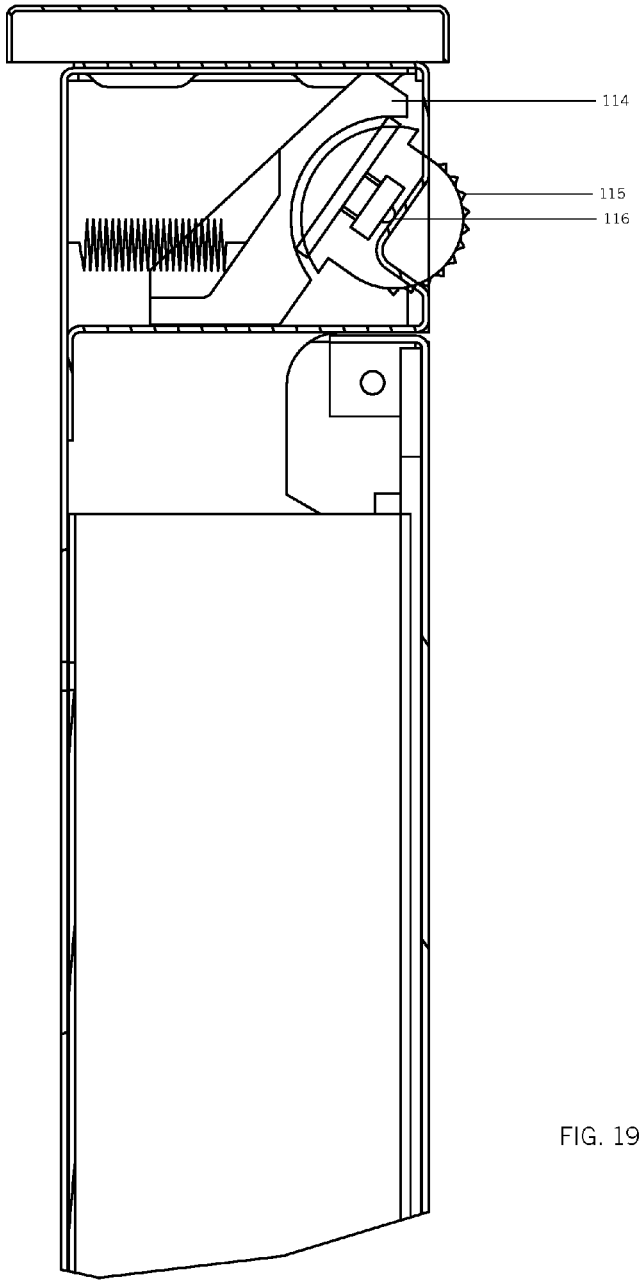
FIG. 19 shows a side view of a lighting system for fuse in conjunction with the present invention.

With the present invention, the lighting system 46 may be adjusted to different angles, as shown in FIG. 19. More specifically, lighting system 46 may include a light mounting base 114 and a position adjustment wheel 115, which may be rotatably attached to mounting base 114. Light 116 is attached to light mounting base 114. As position adjustment wheel 115 is rotated, the angle of the light from light 116 may be adjusted. Further, the lighting system 46 may be easily removed and cleaned.

The lighting system 46 may be adjustable from horizontal to 90 degrees vertical and up to 360 degrees of horizontal movement providing precise, effective lighting control.

The light system 46 may be comprised of a track, slide, or rail system for being able not only to move lights but also the ability to move and reconfigure a track, slide, or rail system for locating the lights where they are needed. Being able to place the light as desired may provide the user freedom to determine the optimum viewing angle for each situation. The use of low voltage for powering the lights opens up to providing the user safety in the ability to move lights around. In accordance with this invention the lights may be adjusted on the rails, slide, or track as well as having the ability to be adjusted for any desired angle. The use of a fixed non-moving light may be used but the position of this fixed light could still be adjusted on the slide, rail, or track of a light management system.

In accordance with this invention the lighting system 46 may be a fixed light location but still provide the movement for redirecting the light. This method of having the light fixed may be accomplished by using different types of connectors: outlet box cover types for hard wiring, canopy adapter types allows any lamp holder to be installed by mounting to a connector. Other methods of attachment for electrical connections can be made in a variety of ways, which can be a snap in connector, which locks into a special adaptor like that found in track lighting or a live end type, or floating canopy type, live end conduit fitter, or a cord and plug connector. All of these designs may be formed into the metal of a telescoping downdraft ventilator. With the use of low voltage lighting, lights may have the transformer as part of the light heads. This lighting system 46 may provide a fully polarized and grounded system for added protection.

In accordance with this invention the use of low cost and low voltage fluorescence type lighting may be used. This long bulb may be fixed at the top of the inner member 30 or in a rotating head at the top with the ability to aim the light up or down or left to right. This design for rotating would comprise a cylinder type frame with the bulb inside and with a slot and cover protecting the bulb, but permitting light to be let out. This cylinder would be located at the top of the inner member 30 below the trim cap 46. When turned on the cylinder may be rotated downward with the top of the slot moving down and blocking light for shining up. This cylinder may also be hinged so as to be moved from right to left to angle the light. The design of this light is such that when the ventilator is moved down the light returns to the proper location for closure without the user having to move the light back. Additionally, lights of any color or lenses may be used to create a decorative accent along with controls to turn on, dim, brighten and turn off the lights.

In accordance with this invention the lighting system 46 may include a holder, e.g., black Coilex® baffles to reduce glare and enhance appearance. This invention provides unlimited light levels for the user to use, which may reduce glare or dark spots on the range, cook top or work surface.

11) Cooling Treated Air for Return to Room

Figure 17:
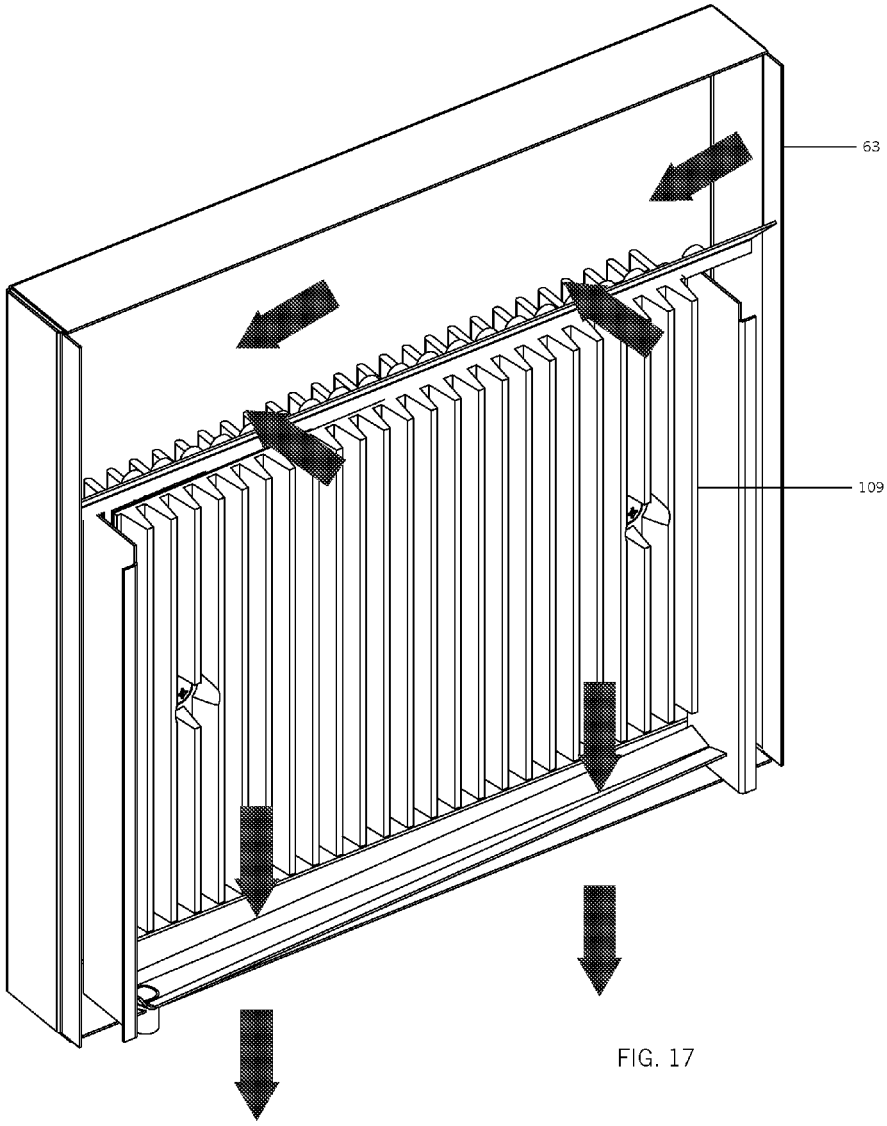
FIG. 17 shows a cooling element for use in conjunction with the present invention.

In accordance with this invention, a telescoping downdraft ventilator 10 may include a cooling element 109 that may be positioned near discharge body 63, as shown in FIG. 17. Alternatively, the cooling element 109 may be secured to the inside of the inner member 30 or housing 20 (depending on the location of fan 64) or remotely to circulate the heated air through the cooling apparatus which will provide better heat control to a non-ducted telescoping downdraft ventilator 10.

With the air circulating over a cooling source (as indicated by the arrows in FIG. 17), the undesired heating-up of a room can be reduced or even eliminated. The cooling element 109 may be a heat pump, electric chiller, or a phase change refrigerant such as that found in commercial freezers, or electric cooling heat exchangers. As shown by the arrows in FIG. 17, the air passes over the cooling element 109 and exits the discharge body 63, preferably near the bottom of discharge body 63 and into an exhaust vent.

12) Sensors

In another aspect of the present invention, a sensor 92 may be used to control the fan 64 or plurality of fans 64. Sensor 92 may be one of a variety of sensors, e.g., a humidity sensor, CO, CO2 sensor, NDIR technology, hydrocarbon detectors or temperature sensors. Electronic sensing is more accurate and faster in sensing heat/temperatures/CO/CO2/Hydrocarbons, than mechanical sensors or by a user. Sensors 92 can be used with electronic controls at different locations to provide a better response and results in better exhaust capabilities with little or no input required from the user.

In one example, ventilator 10 may be equipped with a sensor 92, e.g., an AC or DC electronic temperature sensor, located inside the inner member 30 or at a remote location such that the temperature of the appliance can be detected accurately. This may provide control and operation response to sense temperatures on the range or on the surface and then have the electronic control board 80 control the exhausting functions for height of inner member 20, whether the fan 64 should be turned on, and the speed of fan 64.

A sensor 92 for detecting heat/temperature, CO, CO2, Hydrocarbons, or power using such devices as thermos/thermal detection devices for the control of the exhaust may be used in conjunction with the electronic control board 80. Further, the fan 64 may be electronically connected to a sensor 92 to protect the fan in the event of a fire, i.e., by it turning off. Further, a sensor 92 may be included to detect backpressure in the exhaust stream, which may be caused by strong winds at the house discharge vent. In such a scenario, the appliance may sense the increased backpressure and increase the fan speed to maintain the proper volume of extraction while overcoming the backpressure.

With the user able to select settings or preset settings for the electronic controls, the settings which are needed to maintain the desired exhaust within the ventilator unit 10 may be sensed by a sensor 92 within a predetermined desired range of operating temperatures or set points. The sensor 92 may be mounted on the electronic board 80 or it may be attached to any wall or location in which detection of the temperature is desired.

13) Remote Control Sensing

Figure 20:
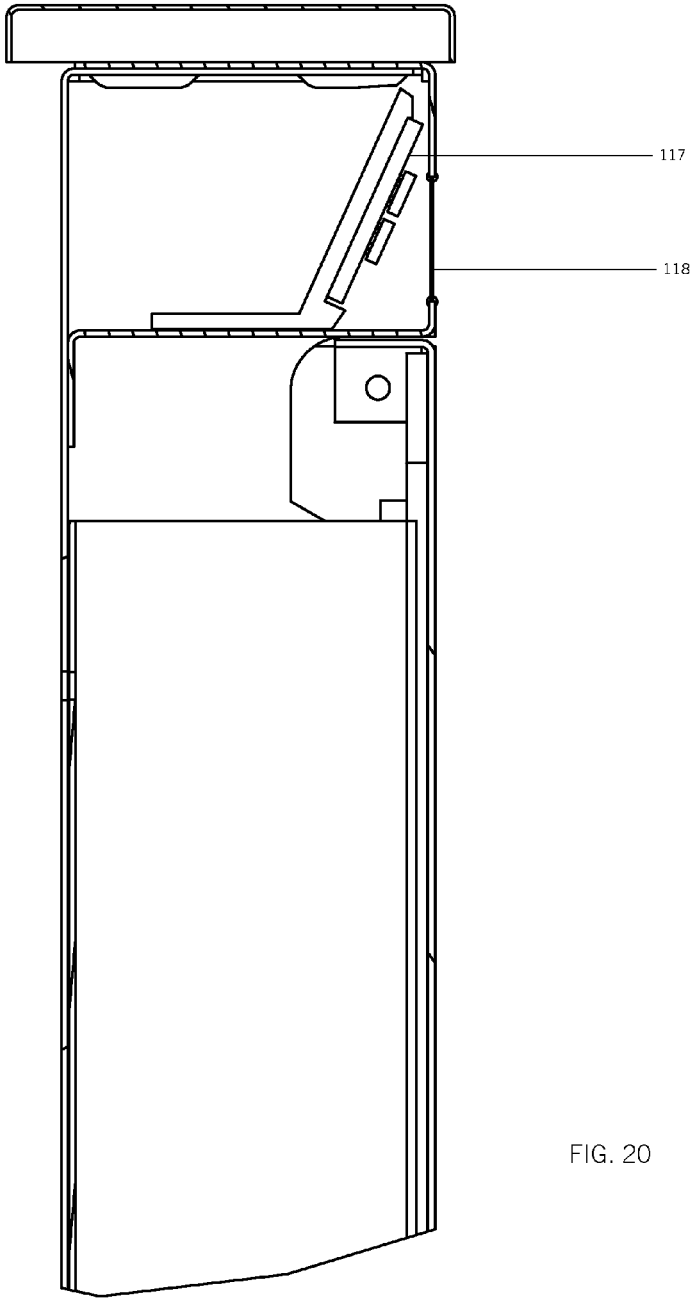
FIG. 20 shows a side view of a remote control sensing system for use in conjunction with the present invention.

Another aspect of the present invention is the ability to use remote control and sensing. As shown in FIG. 20, the ventilator 10 may include a remote receiver 117 (or alternative remote sensor) and an IR transmission window 118, both of which may be located near the upper end of the inner member 30. The ventilator 10 may further include a remote control panel. The sensor unit includes a transducer to sense the physical parameter on the cook top or range. The transducer generates an electrical signal representative of the physical parameters and applies the data to a processor. The processor drives a digital display, which produces visual indications of these parameters. The processor provides communication between the sensors and the remote receiver to which operation of the ventilator 10 is provided. The receiving unit may control the fan 64, e.g., by turning fan 64 on or off or by adjusting the fan speed. The sensors and receivers could both have a transmitter and/or receiver to enable communication through signals, which may be needed in order to change set points or detection points.

A remote sensing and receiving system is configured as a remote keypad. The keypad apparatus includes a display and a remote transducer unit having a temperature sensor unit or other transducer exposed to the cook top/range. The temperature sensor unit may be mounted near the cook top/range such that proper detection may be made. However those skilled in the art will appreciate that the temperature sensor unit may assume any suitable location which allows it to sense the temperature on top of a range/cook top.

The temperature sensor unit is configured to convert temperature readings into an electrical signal representative of the cook zone for transmission to the remote display/control unit. In response to a certain temperature, the data is displayed and transmission of operation requirements is sent to the telescoping downdraft ventilator for processing and operation of telescoping downdraft ventilator functions.

The physical parameters measured by remote sensing and receiving system are not limited to temperature. For example, the quality of the air is measured for CO or CO2 or other gasses for fire fighting. Transducer Technology, Inc offers a T series carbon monoxide sensor using nano-particulate technology for sensing or the amperometric electrochemical sensor. In the event of grease fire or other fires caused by the user or other source of fuel, remote sensing and remote control can activate a fire extinguisher. The fire extinguisher can be stored under the cabinet and piped to the front top inner member with the spray nozzle placed at the highest point for delivery. The microprocessor controls on the control board control the various circuits associated with the receiver. The various devices coupled to the microprocessor are devices used to control the other functions within the telescoping downdraft ventilator.

14) Temperature Sensing

In accordance with this invention, a ventilator 10 may be equipped with an electronic temperature sensor 92 located inside the ventilator 10, e.g., on the inner member 30 or housing 20, or in the top trim cap 54, such that the temperature inside or next to the ventilator can be detected accurately. The sensor may sense temperatures on the range or in the ventilator and then have the electronic control board 80 control the exhausting functions of fan 64, e.g., fan speed.

With reference to the present invention temperature sensor 92 can be Resistance Temperature Detectors (RTD), Thermistors, IC sensors, Radiation Sensors, Thermometers, bimetallic, IR and thermocouples.

A widely used device for measuring temperature is the RTD, which may be relatively lower in cost. Even though RTD sensors tend to be relatively slower in response than thermocouples, which are used in current ventilator designs, RTD offer several advantages. RTD are stable and they have great thermal shock capability. This is important when transporting an appliance outfitted with ventilator 10. Another advantage is that an RTD does not require a special compensating lead wire or cold junction compensation.

An RTD senses the electrical resistance of certain metals, which increases and decreases in a predictable manner as the temperature increases or decreases. The most commonly used metals for RTDs are platinum, copper, and nickel. The reasons for selecting these three metals over others are: first, these three metals are available in near pure form, this is important to insure consistency in manufacturing process. Second, these metals offer a very predictable temperature versus resistance relationship; they are almost linear. Third, they can be processed into extremely fine wire.

After the sensor generates a signal, a conditioning device called a transmitter may be used. This transmitter is used to convert the signal from the sensor to an electrical signal recognizable by the control board 80. The transmitter may be of a type such as a four-wire, three-wire, or a two-wire circuit, but other methods can be used. Preferably the connection is the four-wire circuit, which may eliminate errors caused by mismatched resistance of lead wires. A constant current is passed through each of the leads and a measurement for the voltage drop across the RTD is provided. With a constant current, the voltage is strictly a function of the resistance and a true measurement is achieved. This method provides the best accuracy in detecting the temperature at or near the ventilator 10.

In one example, a simple circuit including an RTD temperature sensitive element measures temperature from ambient to elevated temperatures. These measurements may be displayed, or they may be processed by the electronic control board 80, which may in turn adjust the fan accordingly. The above discussed circuit may be contained on a chip, which may be placed in a desired location for temperature detection. This circuitry provides data/information to the electronic control board 80 for controlling the ventilator 10.

Another example of a temperature sensor 92 that may be used is a distributed temperature sensor, which offers the next generation fiber optic distributed temperature sensor (DTS) that senses temperature at every point along a SS sheathed fiber and features a resolution of 0.5° C. and a spatial resolution of 1.5 m. The fiber can range up to 2,000 m and can be coiled at specific points of interest. Fiber can be sheathed with a nonconductive polymer for intrinsic applications. This method provides the ability to profile a range/cook top for detection of temperatures. In the other methods for detection, temperatures must reach the sensor, which is in one or more than one locations. With this method many locations for detection points are provided. The strip can be installed along the complete front of a telescoping downdraft ventilator trim at the edge. Response times are shorter and this provides the control board 80 the ability to sense the complete top of a target zone, which may enable the manufacturer to customize the zones by including more points for detection.

With reference to the present invention, the telescoping downdraft ventilator may be built into/on a Mobile Island or cart for use with grilling/cooking equipment. The unit may be mobile so one does not need to have it installed into/on a cabinet or structural or supporting frame (self supporting or free standing).

In accordance with this invention, a telescoping downdraft ventilator 10 may be used in outdoor locations. The telescoping downdraft ventilator 10 has the ability to weather the outdoor temperatures and environment. The use of electronics for controlling the telescoping downdraft ventilator 10 provides better sealing for these environments. Employing remote locations for controls, the electronics or a portion thereof can provide remote operation of a ventilator used outdoors thus reducing the effects of that environment on some of the controls. Electronics are not subject to mechanical problems such as increased turning force do to low temperature conditions. They are more resistant than mechanical controls and switches to environmental conditions and problems, one example being a tactile switch with added material for buttons or pads that can develop rust or dust build up. Electronic controls are also not subject to cleaning problems experienced with mechanical and tactile switches. Electronic controls can be best suited to outdoor applications where extreme temperatures and weather conditions exist, because they do not have mechanical moving parts that may fail.

16) Touch Control

Another aspect of this design is the ability to have no switch controls, i.e., the metal frame acts as the switch. A user can touch the telescoping downdraft ventilator surface in the front or sides of the trim cap 54 and this would operate the ventilator by raising the inner member 30 and turning on the fan 64. The user can touch the trim cap 54 and when released the inner member would stop moving up or down. A user could touch the telescoping downdraft ventilator 10 a number of times, and in response the fan 64 would speed up or slow down. The user could touch the telescoping downdraft ventilator 10 and hold for a longer time, and in response the fan 64 would turn off or on. Having the user touch a metal area on the telescoping downdraft ventilator 10 results in the lighting system 64 turning on using the same methods of touch and control as for the fan 64 and height of the inner member 30 discussed above.

17) Sound/Voice-Activated System

Another aspect of the present invention control of the ventilator 10 using voice commands. The sound or voice-activated system lets the user speak to the telescoping downdraft ventilator and state what controls and operations they want. Also it provides the user the ability to be hands free. The telescoping downdraft ventilator may be hooked up to a computer or other similar system for operation and control.

18) Venting

In accordance with this invention, the ventilator 10 may include a slide 111 driven by motor 112 to close off openings 34. For example, the telescoping ventilator can have a slide 111 with gear teeth 113 that engage motor 112, which opens and closes openings 34. Alternatively, slide 111 may be driven by a bimetal device, solenoid, electromagnetic, or other electronically or an electro-mechanically controlled shut-off device.

Motor 112 may be any one of a number of devices. For example, motor 112 may be a linear motion device or a wax motor. The device is designed to regulate the flow of air being exhausted or brought in.

The air inlet or outlet may be opened all the way (i.e., full open) or closed all the way (i.e., sealed cavity). The vents may be fully opened or closed, or opened to a varying degree to control heat and contamination build up, but also supply return air for proper burning of gas when used as the fuel source. With the use of a forced air (powered) or circulating system, even greater control may be possible with a power venting system. For example, the damper or slide allows for proportional flows to control air movement and heat.

Figure 18:
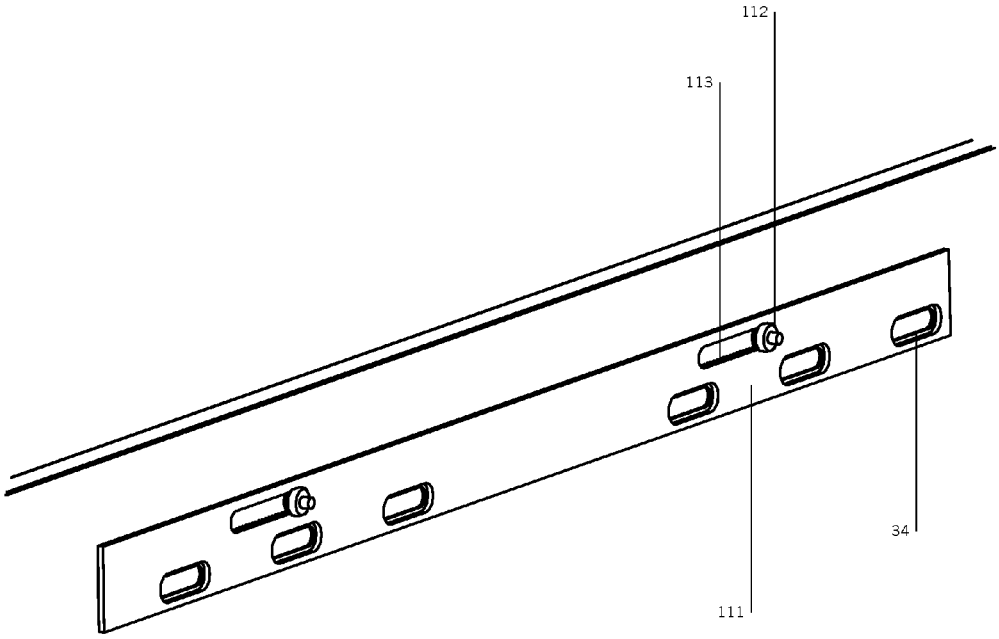
FIG. 18 shows a venting system for use in conjunction with the present invention.

FIG. 18 shows the openings 34 in the front of the inner member at the top, but other openings for could be placed at any location in a telescoping downdraft ventilator. The design may be made of any venting design, which may permit air to leave or enter and any type of design that could be used to close off the vents. The venting may be performed by a motor, an actuator, or any device capable of opening closing or opening the vents. Furthermore, the slide system shown in FIG. 18 may be located near the bottom of inner member 30, which may provide additional airflow to the back burners.

19) Programming

In accordance with this invention a telescoping downdraft ventilator designed for use with electronics can provide programmable and selectable set points, set times, and set operations as well as the setting of times both on and off or changes in functions, set points, speed, or operations. The ventilator may provide the ability to select multiple functions, operations and times. Timed on/off control can provide the ability to control the on/off time of the drawer. On/off times can be nearly infinitely set with the use of electronics. This programmability/select ability provides the advantage of being able to enter different functions or operations, more than one, into the electronic control and have the telescoping downdraft ventilator control all desired functions an advantage over mechanical or single function units. You can have one, two, or more functions, operations, set points (height), speeds, with limitless programming and selections for control of these items. An electronic controlled telescoping downdraft ventilator permits more user freedom.

Programming can be done when the user rises the telescoping downdraft ventilator to a set position and wishes to repeat that position. Once user has reached a set point, user can select this height using the user interface 36, e.g., by pressing a program key on the keypad to preset this location for returning to at some other time. Other heights could be set also. All the user would then have to do is press the set point keypad button and the unit would return to that height.

20) Unidirectional Air Removal

In accordance with this invention a telescoping downdraft ventilator has the ability to draw contaminated air unidirectional, or from one direct from the front at the top. See FIGS. 1-9. This ability would permit the drawing of air from the front or back when the user has one cook top/range on and also from the front and the back at the top of the inner member when a user has two cook tops/ranges back to back on. This design permits the designer the ability to locate the electrical at one location and also the ability to use one ventilator for two cook tops/ranges. This design also lets the user place two cook tops/ranges back to back on an island location.

21) Treated Air Return

Figure 10:
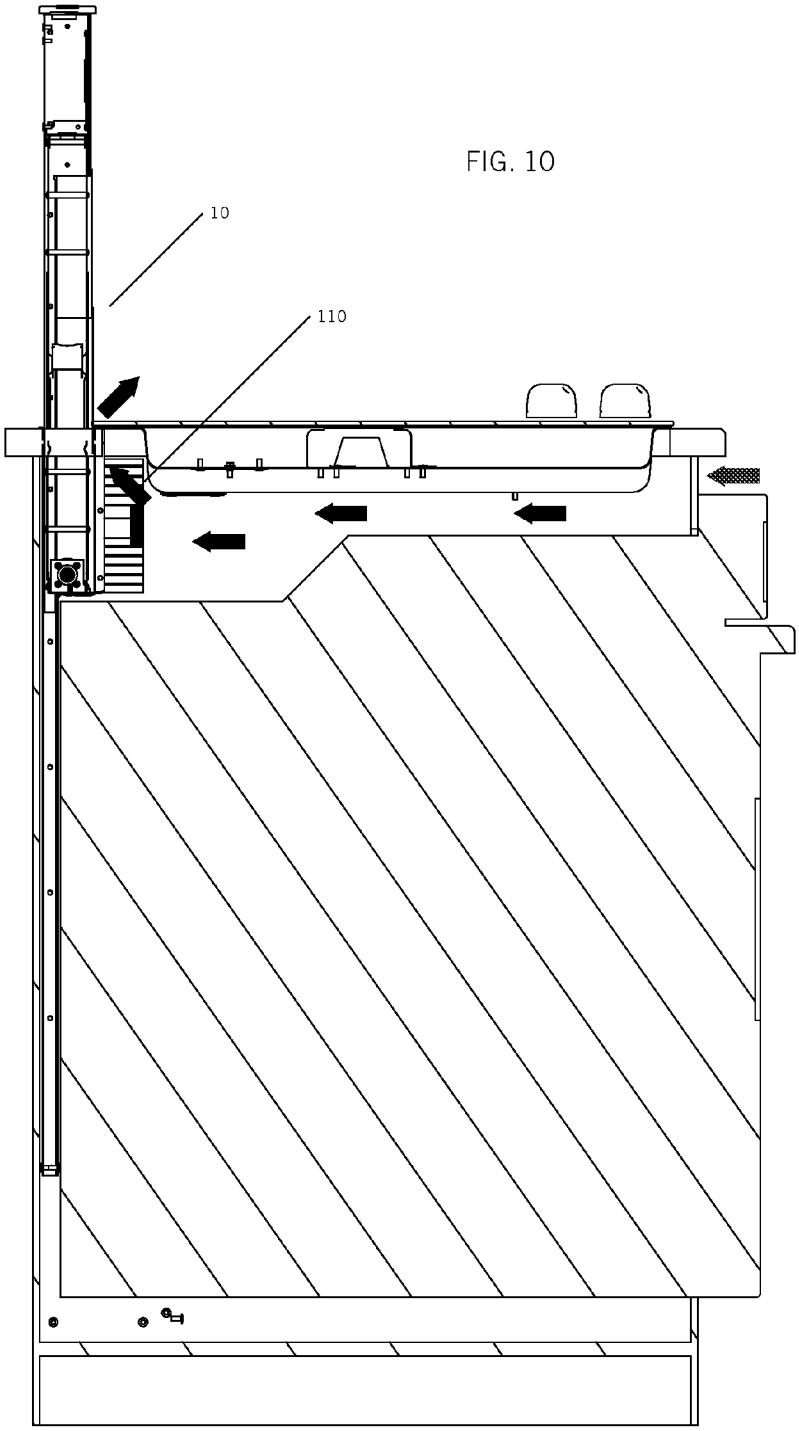
FIG. 10 shows a side view of the embodiment of FIG. 4 in combination with an oven/cooktop.

As shown in FIG. 10, the ventilator 10 may supply a fresh stream of air to the cook-top. A blower 110 ducts air out of the back or front of a ventilator 10 and returns the air at the bottom of the inner member 30 (as shown by the arrows in FIG. 10) to the cooking area, while contaminated air is drawn into the intake opening 34 at the top of inner member 30.

22) Rotating/Pop Up Display

Figure 16:
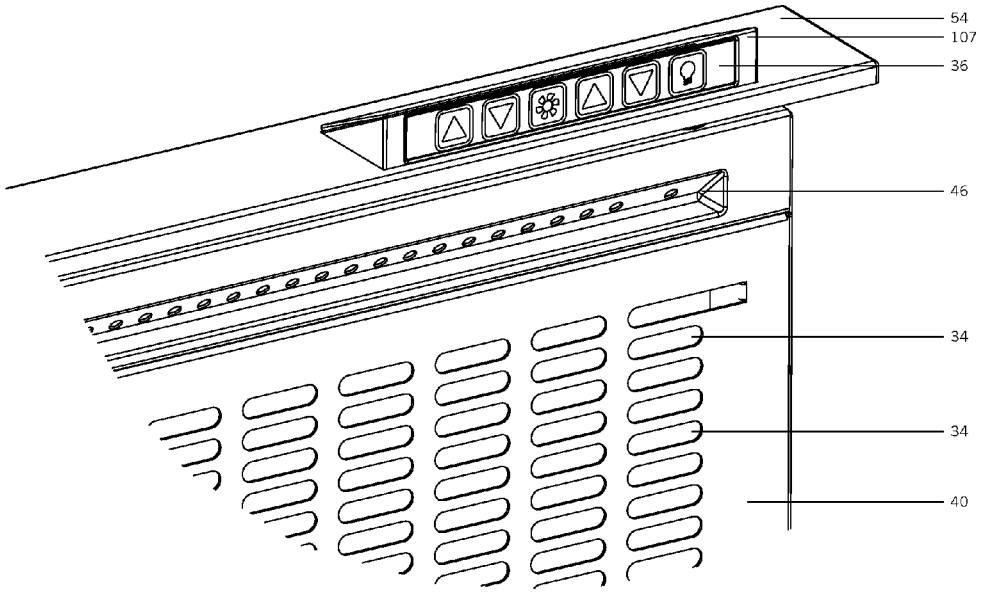
FIG. 16 is an enlarged an enlarged perspective view of still another embodiment of the present invention.

In another aspect of the present invention, the ventilator 10 may be equipped with a rotating or pop-up user interface 36, as shown in FIG. 16. Concealing the user interface 36 may protect it from damage. The user interface 36 may be placed on a rotating panel, e.g., a drum, an L shaped plate, or a triangle shaped part. The rotating part may be operated manually, or it may be automatically controlled by the ventilator 10, e.g., by control board 80. For example, the user may touch the panel 107 to initiate movement. Further, if the display board and the ventilator 10 have been off for a predetermined time, panel 107 may rotate to a closed position. A motor or some other means of rotating the display assembly may be used. Switches, stepper motors or magnetism may be used to determine the location of stop points. Also the user may manually press down on the panel 107 to move the display to a closed position.

23) Fold Out Shelf

In another aspect of the present invention, the ventilator 10 may be equipped with a fold out shelf 105, as shown in FIG. 17. As the inner member 30 rises up, the shelf 105 is folded out, providing the user a ledge for placing spices or other small items. As the inner member 30 retracts, the shelf 105 is folded up and out of the way.

24) Fold Out Steam Shield

Figure 15:
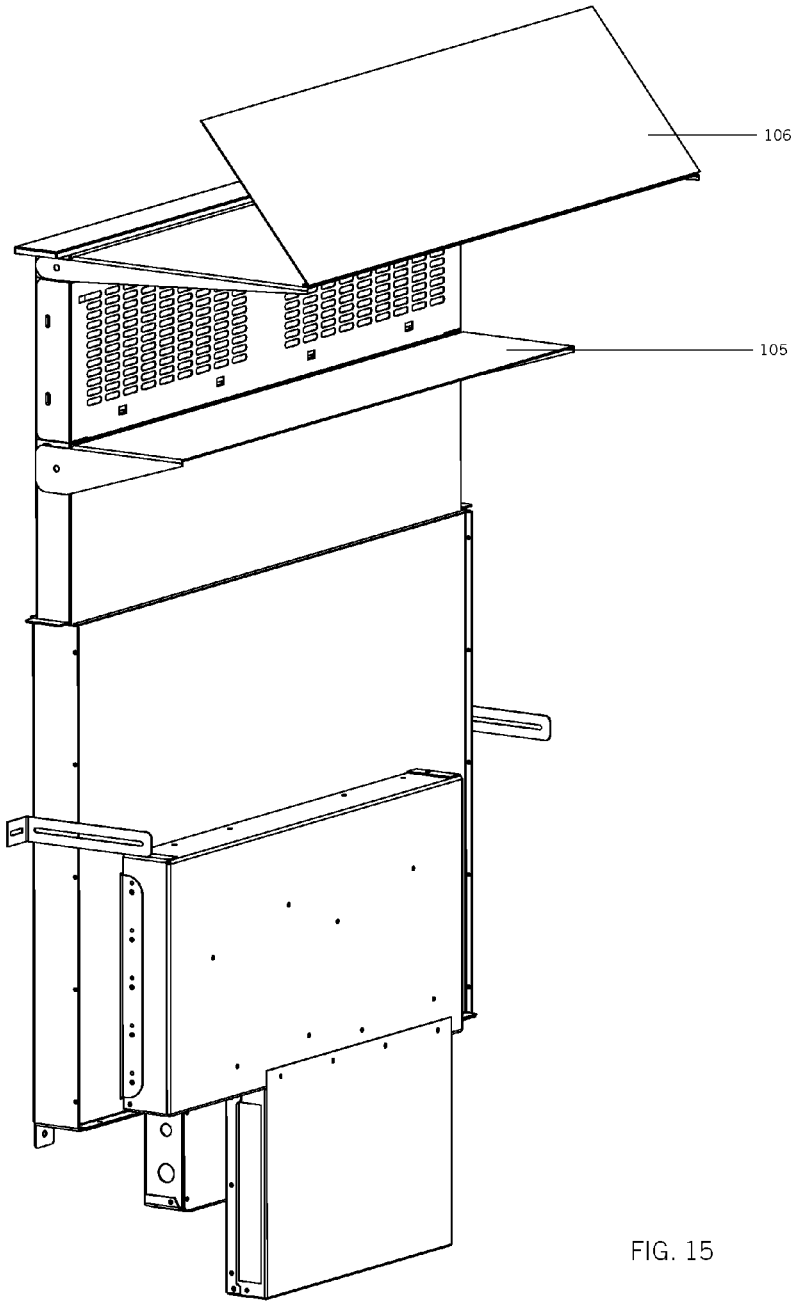
FIG. 15 shows yet another embodiment of the present invention.

In another aspect of the present invention, the ventilator 10 may be equipped with a fold out steam shield 106, as shown in FIG. 15. Shield 106 unfolds when the telescoping downdraft ventilator is raised to a stopping point for operation. The shield 106 would extend from the top of the inner member 30 outward and would act as a steam shield, which may aid in the removal of contaminated air. As the inner member 30 retracts the shield 106 is folded up and out of the way. The shield 106 may be folded manually or by a mechanism for retraction.

25) Decorative Trim

Another aspect of the present invention is the ability to have a telescoping downdraft ventilator for the decorative top trim having a fixed outer rim edges secured to a counter or other support and having a center plate movable with the inner member. The outer decorative trim rim is fastened to the counter or other type of support frame for the telescoping downdraft ventilator providing the structural support needed to secure the unit in place. The inner plate can rise and retract with the elevating of the inner member, which is positioned into the center section of a rectangular fixed trim.

The construction of the invention is an outer trim rim that has the center section opened, resting on a counter top or on a support member. The center opening has a step on both sides with screw holes for securing to a counter top or a support member. The screw holes are recessed so as not to interfere with the inner plate. The inner plate is secured to the inner member of the telescoping downdraft ventilator. The attachment of the inner plate to the inner member, can be done by: mechanical fasteners, adhesives, welding, or other ways of locking the two parts together. The inner plate moves up and down and fits into the center section of the outer trim. Resting on the step, the inner plate, provides the stopping point for the down position. This also provides for a clean looking fit. This improved design also addresses the fit up problems of a one-piece trim used on present ventilators. One-piece trim leaves gaps and trap points when spills occur. This novel invention does away with the issues of the trim being made of thin materials that dent when struck by a pan. With the ability to use many materials and castings one can provide a number of looks, styles and finishes. Having a protective mass of material protecting the inner plate and acting as a barrier to fluid flow this invention provides the user the rich look and feel of a high end design and addresses the issues of the present ventilators.

It should be clear that there are virtually innumerable uses for the present invention, all of which need not be detailed here. All the disclosed embodiments can be practiced without undue experimentation.

Although the best mode contemplated by the inventors of carrying out the present invention is disclosed above, practice of the present invention is not limited thereto. For example, it will be manifest that various additions, modifications and rearrangements of the features of the present invention may be made without deviating from the spirit and scope of the underlying inventive concept. In addition, the individual components need not be fabricated from the disclosed materials, but could be fabricated from virtually any suitable materials. Moreover, the individual components need not be formed in the disclosed shapes, or assembled in the disclosed configuration, but could be provided in virtually any shape, and assembled in virtually any configuration. Further, although many elements and components are described herein as physically separate modules, it will be manifest that they may be integrated into the apparatus with which it is associated. Furthermore, all the disclosed features of each disclosed embodiment can be combined with, or substituted for, the disclosed features of every other disclosed embodiment except where such features are mutually exclusive.

Various alternatives are contemplated as being within the scope of the following claims particularly pointing out and distinctly claiming the subject matter regarded as the invention.

We claim:

1. A downdraft ventilator comprising:

a housing and an internal member sized to fit within the housing;

wherein the housing and the internal member combine to form a duct, the duct having an intake opening;

wherein the internal member is slidable within the housing so as to be telescoping with respect to the housing, wherein the internal member is slidable between a fully extended position and a fully retracted position;

wherein the internal member includes a rear panel, first and second end panels, and a front panel, and wherein the front panel has an upper perforated surface and a lower perforated surface spaced from each other by a non-perforated surface, and wherein the lower perforated surface remains within the housing when the internal member is at the fully extended position;

an actuator operatively connected to the internal member and the housing, wherein the actuator moves the internal member with respect to the housing;

a first fan positioned at one end of the duct and second fan positioned at a second opposite end of the duct; and an electronic control system that controls the actuator and the fans, the electronic control system having a user interface.

2. A downdraft ventilator according to claim 1, wherein the user interface is a keypad.

3. A downdraft ventilator according to claim 2, wherein the keypad is located on the down draft ventilator.

4. A downdraft ventilator according to claim 1, further comprising a filter positioned within the ventilator so that at least some of the air that is drawn in through the intake opening passes through the filter.

5. A downdraft ventilator according to claim 4, further comprising an air flow sensor positioned behind the filter.

6. A downdraft ventilator according to claim 5, wherein the air flow sensor communicates with the electronic control system, wherein an air flow limit is stored within the control system, and wherein the control system indicates that the filter needs to be changed when the air flow through the filter is at or below the air flow limit.

7. A downdraft ventilator according to claim 6, wherein the air flow limit is adjustable.

8. A downdraft ventilator according to claim 1, wherein the inner member is capable of being positioned at any desired position between a first position and a second position.

9. A downdraft ventilator according to claim 8, wherein the first position is where the inner member is fully retracted within the housing and wherein the second position is where the inner member is fully expanded beyond the housing.

10. A downdraft ventilator according to claim 1, wherein the actuator is a screw drive.

11. A downdraft ventilator according to claim 1, wherein each fan has a fan speed that is adjustable along a range between a first fan speed and a second fan speed, and wherein a desired fan speed may be selected between the first fan speed and the second fan speed.

12. A downdraft ventilator according to claim 11, wherein the first fan speed is when the fan is off and wherein the second fan speed is when the fan is operating at a predetermined maximum speed.

13. A downdraft ventilator according to claim 1, wherein the inner member has a lighting system that is controlled by the electronic control system.

14. A downdraft ventilator comprising:

a housing having a top end and a bottom end;

an internal member sized to fit within the housing, the internal member having an intake opening;

wherein the housing and the internal member combine to form a duct, and wherein the internal member is telescoping with respect to the housing so as to allow for a portion of the intake opening to extend beyond the top end of the housing;

an actuator operatively connected to the internal member and the housing, the actuator being configured to move the internal member with respect to the housing;

a fan located at an upper end of the internal member;

an electronic control system that controls the actuator and the fan; and a second fan located at the bottom end of the housing, wherein each of the fans is a centrifugal blower.

15. A downdraft ventilator according to claim 14, wherein the inner member is capable of extending about 15 inches beyond the top of the housing.

16. A downdraft ventilator comprising:

a housing and an internal member sized to fit within the housing, the housing and the internal member combining to form a duct;

wherein the internal member has an upper end with an intake opening, wherein the inner member is slidable within the housing so as to be telescoping with respect to the housing so as to allow for a portion of the intake opening to extend beyond an upper end of the housing, and a plurality of fans positioned at the upper end of the internal member;

an actuator operatively connected to the internal member and the housing, the actuator being configured to move the internal member to a desired position with respect to the housing; and an electronic control system that controls the actuator and the fan, the electronic control system having a user interface.

17. A downdraft ventilator according to claim 16, wherein each one of the plurality of fans is a centrifugal blower.

18. A downdraft ventilator according to claim 17, wherein each of the centrifugal blowers has a depth of about ½ inch.

19. A downdraft ventilator according to claim 16, wherein the inner member is capable of extending about 15 inches beyond the top of the housing.

* * * * *